US009222249B2

(12) United States Patent
Boardman

(10) Patent No.: US 9,222,249 B2
(45) **Date of Patent: *Dec. 29, 2015**

(54) METHOD AND APPARATUS FOR DESIGNING, PRODUCING, MANFACTURING AND DELIVERING PERSONALIZED LIVING ENVIRONMENTS

(71) Applicant: Paul B. Boardman, New York, NY (US)

(72) Inventor: Paul B. Boardman, New York, NY (US)

( * ) Notice: Subject to any disclaimer, the term of this patent is extended or adjusted under 35 U.S.C. 154(b) by 190 days.

This patent is subject to a terminal disclaimer.

(21) Appl. No.: 13/751,402

(22) Filed: Jan. 28, 2013

(65) Prior Publication Data

US 2014/0033637 A1 Feb. 6, 2014

Related U.S. Application Data

(63) Continuation of application No. 12/460,396, filed on Jul. 17, 2009, now Pat. No. 8,364,620.

(60) Provisional application No. 61/135,148, filed on Jul. 17, 2008.

(51) Int. Cl.
*E04H 1/00* (2006.01)
*E04B 1/00* (2006.01)
(Continued)

(52) U.S. Cl.
CPC ..... *E04B 1/00* (2013.01); *E04B 1/3483* (2013.01); *E04C 3/30* (2013.01); *E04F 19/00* (2013.01); *E04B 2001/2472* (2013.01)

(58) Field of Classification Search
CPC . E04B 1/00; E04B 1/3483; E04B 2001/2472; E04F 19/00; E04C 3/30
USPC ..... 52/27, 79.1, 127.1, 173.1, 311.1–316, 52/741.1, 782.1, 783.1, 750; 706/12, 45, 706/62
See application file for complete search history.

(56) References Cited

U.S. PATENT DOCUMENTS 3,665,662 A 5/1972 Timbrook et al.
3,720,022 A 3/1973 Dattner
(Continued)

OTHER PUBLICATIONS

Jung, K-Y. et al. "Development of Design Recommender System Using Collaborative Filtering". ICADL 2003, LNCS 2911, pp. 100-110, 2003.

*Primary Examiner* — Mark Wendell
(74) *Attorney, Agent, or Firm* — John J. Skinner, Jr.

(57) ABSTRACT

A method and apparatus for the creation, selection, ordering, shipping and constructing of personalized living environments with customized configurations through the use of an architectural process, unitized assemblies, and assembly joineries. The architectural process allows for the initial creation, design and selection of the unitized assembly collections based upon human factors behavioral based criteria. The unitized assemblies are fixed and/or flexible, trade-integrated modules in unitized, shippable configurations designed and incorporated with high touch finished crafts, allowing for dimensional flexibility. The unitized assembly and human factors behavioral analysis combine for an experience blueprint of a homeowner's lifestyle portrait. The assembly joineries, based upon the desired collections selection, provide finishing touches to the unitized assembly, efficient strength to weight ratios, and expressed, stylized configurations in hybrid materials. The combination of the physical constructs with the behavioral process allows for "mass customization" in the design, production, manufacturing and delivering of personalized living environments.

20 Claims, 37 Drawing Sheets

(51) Int. Cl.

| | |
|---|---|
| ***E04B 1/348*** | (2006.01) |
| ***E04C 3/30*** | (2006.01) |
| ***E04F 19/00*** | (2006.01) |
| *E04B 1/24* | (2006.01) |

(56) References Cited

U.S. PATENT DOCUMENTS

| | | | | |
|---|---|---|---|---|
| 4,012,871 | A | 3/1977 | Netto et al. | |
| 4,091,142 | A | 5/1978 | Elmore et al. | |
| 4,653,238 | A | 3/1987 | Berman | |
| 4,686,807 | A | 8/1987 | Newsome | |
| 4,943,336 | A | 7/1990 | Csont | |
| 5,493,839 | A | 2/1996 | Sax et al. | |
| 6,041,562 | A | 3/2000 | Martella et al. | |
| 6,076,320 | A | 6/2000 | Butler | |
| 6,681,544 | B2 | 1/2004 | Wall | |
| 6,705,051 | B1 | 3/2004 | Wall | |
| 7,200,972 | B1 | 4/2007 | Freeman et al. | |
| 7,835,810 | B2 | 11/2010 | Mifsud et al. | |
| 8,364,620 | B2 * | 1/2013 | Boardman | 706/45 |
| 2003/0089070 | A1 | 5/2003 | Wall | |
| 2005/0284088 | A1 | 12/2005 | Heath | |
| 2006/0059792 | A1 | 3/2006 | Tiramani | |
| 2008/0126020 | A1 | 5/2008 | Hoguet | |
| 2008/0276555 | A1 | 11/2008 | Larson et al. | |
| 2009/0223144 | A1 | 9/2009 | Leahy | |

* cited by examiner

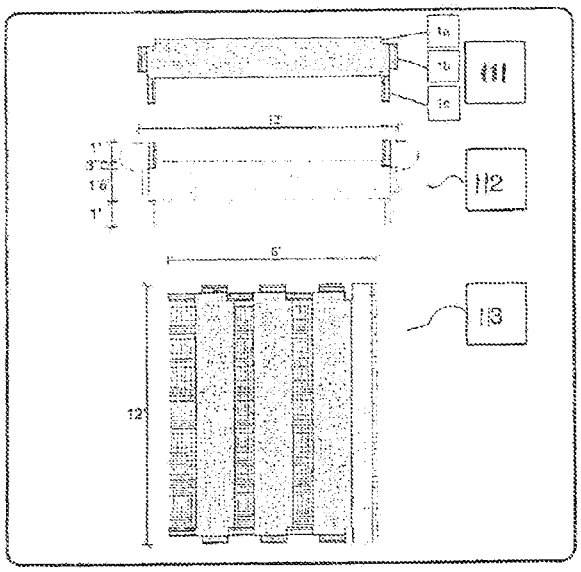
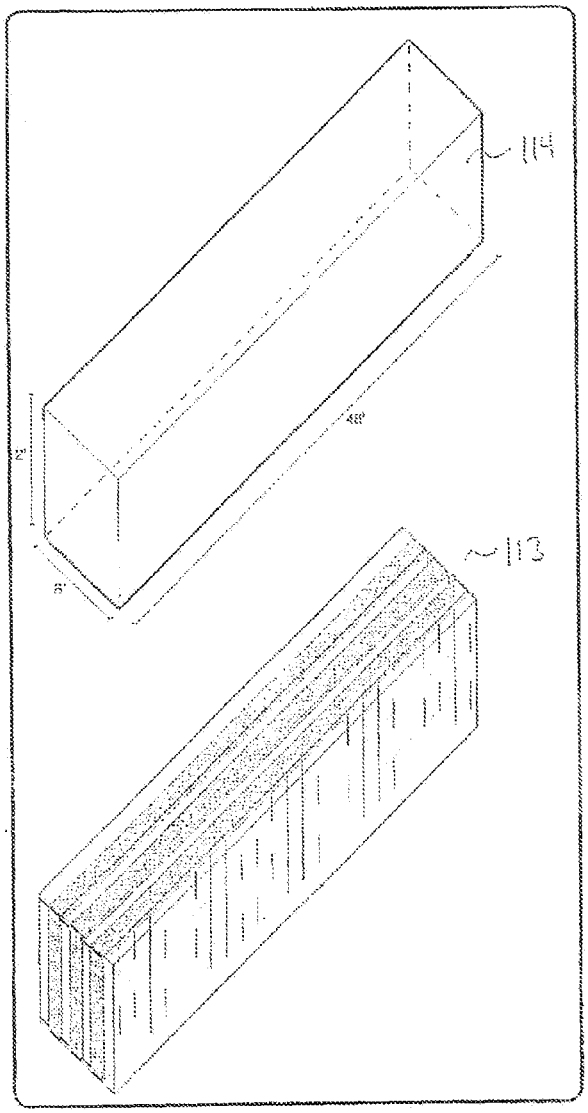
Fig. 2 (f)

Designed for Desire: Examples of behavior mapping

| (COLUMN 1) | (COLUMN 2) | (COLUMN 3) | (COLUMN 4) |
|---|---|---|---|
| **ACTIVE PASSION** | **BEHAVIOR PROFILE** | **BEHAVIOR CHARACTERISTICS** | **BEHAVIOR SEGMENTATION** |
| SAILING | Precise, technical, analytical | Planned, Group/team oriented | Category Planner |
| WINE TASTING | Cultured, studious, curious | Indulgent, sophisticated, large group, social | Category Ex-Urbanite |
| CYCLING | Focused, intense, unrelenting | Performance oriented, urban, patterned | Category Ex-Urbanite |
| MEDITATION | Reflective, singular, contemplative | Introspective, balanced, timeless, not materialistic | Category Explorer |
| THEATER | Extroverted, performer, expressive | Creative, image conscious, | Category Upscaler |
| RACING | Confident, Competitive, Risk Taker | Aggressive, Thrill seeker, limits tester | Category Early Adopter |
| OUTDOOR LIVING | Bold, strategist, visceral | Gender distinct, primitive, basic | Category Upscaler |
| YOGA | Open, truth seeker, balanced | Worldly, community oriented, retreat | Category Explorer |
| COUNTRY LIVING | Caring, nurturing, patient | Organic, seasonal, timely | Category Planner |
| TRAVELLING | Free spirit, spontaneous, adventurous | Transient, international, flexible | Category Downsizer |

Fig. 3

Demonstrative Connections of Passion to Product and Place

| (COLUMN 1) | (COLUMN 2) | (COLUMN 3) | (COLUMN 4) | (COLUMN 5) |
|---|---|---|---|---|
| **COLLECTION** | **ICON** | **MOOD** | **ELEMENTS** | **MATERIALS** |
| AMERICAS CUP | | CRISP, FRESH, REFINED, LIGHT, MOVEMENT | MAST, SAIL, TURNBUCKLE, STAY WIRE | CANVAS, SHINGLES, TEAK, POLISHED STEEL AND CABLE |
| CABERNET | | STILL, WARM, AGRICULTURAL | BARREL, VINEYARD, STRAP, ARBOR, FRESCO, WALL | ROUGHT IRON, PLASTER, BLACK STEEL, BOLTS |
| THE TOUR | | MACHINED, TECHNICAL REFINED, STERLING | TOWN HOUSE, VERTICAL GARDEN, POLISHED HANDLES | POLISHED ST STEEL, CHROME, RUBBER, BLACK LEATHER |
| TEA | | CALM, ZEN, INTROSPECTIVE | JOINERY, SCREENS, TATAMI, ARMOUR, INFINITY GARDEN | OILED FINISH, HAND HEUN, WOOD, NATURAL STEEL |
| TRIANALLE | | VENETIAN THEATRICAL, CREATIVE | DIAMONDS, MASKS, TAPESTRY, | STONE AND STEEL, SILK, |
| AUTOBAHN | | SPEED, POWER, AERODYNAMICS | TAPERED COLUMN, FLUSH SET FASTENERS | GLOSS LACQUER, CHROME, ITALIAN LEATHER |
| THE HUNT | | TRADITIONAL, | EXPRESSED FRAME, TIE BACKS, TUBE STEEL | NATURAL WOOD, PLANKS, SADDLE LEATHER |
| GENTLEMAN FARMER | | ORGANIC, | HEAVY TIMBER FRAME, BARN VOLUME | WOOD PLANK EXTERIOR, FIELD STONE |
| VINYASA | | CONTEMPLATIVE, QUIET | ROOF VOLUME, RAISED DECK | HAND POLISHED WOOD |

Fig. 4

Brand Experience Principles and 6 Moments of Emotion that Matter

| Steps: What to do? | Feelings: What do I feel? | Moments that Matter |
|---|---|---|
| Enter | Anxiousness | 1. Expanding expectations |
| Introduction | Preparation | |
| Environmental Sampling | Motivation | 2. Creating Possibilities in your passions |
| Passion Profile | Inspiration | |
| Testing | Confidence | 3. Structuring Commitment |
| Just-in-time visualization | Excitement | |
| Collection segregation | Confirmation | 4. Preparing for Success |
| Integration/synthesis | Revelation | |
| Manufacturing-QC/QA | Commitment | 5. Realizing your Desire |
| Erection/Installation | Anticipation | |
| Move-in | Accomplishment | 6. Sharing Experiences |
| Entertain/Share | Celebration | |

Fig. 6

Universal Column

Universal Split Beam

America's Cup

Cabernet

The Tour

Tea

Triannale

Autobahn

The Hunt

Gentleman Farmer

Vinyasa

METHOD AND APPARATUS FOR DESIGNING, PRODUCING, MANFACTURING AND DELIVERING PERSONALIZED LIVING ENVIRONMENTS

CROSS REFERENCE TO RELATED PATENT APPLICATIONS

The present application claims the benefit of U.S. patent application Ser. No. 12/460,396, filed Jul. 17, 2009, which in turn claims the benefit of U.S. Provisional Application Ser. No. 61/135,148, filed Jul. 17, 2008, both disclosures of each of which are hereby incorporated by reference.

FIELD OF THE INVENTION

The present invention is directed to a method and apparatus for the designing, producing, manufacturing and delivering of personalized living environments, and, more particularly, to a method and apparatus utilizing proprietary unitized assemblies joined together by various proprietary assembly joineries by which the creating, selecting, ordering, shipping and constructing of personalized living environments can be customized in almost unlimited configurations and effectively performs as a shelter, meeting or exceeding requirements for a code compliant weather resistant living environment.

BACKGROUND OF THE INVENTION

Historically, the design, production, manufacture, and delivery of residential dwellings (i.e., homes) has marginally evolved over time. One of the more familiar paths has been design and construction of "site-built" homes. Site-built homes are extremely popular and are the mainstay of home building.

However, site-built homes necessitate many inefficiencies in the design and construction process to complete and, as they become more complex, they are disproportionately expensive, time-consuming and environmentally inefficient to deliver. For instance, steps to complete the construction of such a home require the organization and sequencing of unrelated labor and material demands to coalesce around a construction system and configuration largely unfamiliar to the work force. These components need to be ordered, shipped, organized, and sequenced through a critical path of construction. The shell for instance cannot proceed until the entire excavation, foundation and sill plates are complete, and the interior finishing cannot start until all the interior mechanical systems are fully installed. And so on and so on. These various steps are necessarily timed in a linear sequence and cannot be "fast tracked" without significant premiums and risk of error. The process is time consuming, variable in quality because of the varying work conditions and labor over the job, subject to weather and labor delays, and highly unpredictable in terms of costs and time. The job conditions are also environmentally taxing because of the extensive transportation of workers and machinery to and from a remote job sight, construction material waste on site, inconsistent waste material disposal, etc. . . . Accordingly, site-built custom homes can take as long as two or three years (or even longer) before the home is ready for occupancy and over that period of development contribute significant greenhouse gasses (GHG) and material waste into the environment.

Beginning in the 1950's, however, a type of housing construction in which the home was largely assembled elsewhere and then transported to the building site began to emerge. Such home building process was known as manufactured, or "pre-fabricated", housing. Pre-fabricated homes can either be constructed through a panelized means of construction ("pre-fab panelized") or a modular means of construction ("pre-fab modular") but the means and methods of construction remained largely conventional.

Prefab modular is an interior finished floor, wall and ceiling assembly making a module "box" that is designed to be stacked or set next to another, joined with a site installed exterior skin to create a living space. Because it is fabricated in its final room dimensions, and conceived to be paired with other modules, the interior size and configurations are limited to road and bridge clearance on the transportation route from the factory to the site. This results in a system that is very rigid dimensionally, inefficient for transportation and shipping, fully integrated but limited in architectural expression and by complexity of site conditions.

Prefab panelized is a panel based system that joins precut panels to make an enclosure. Usually the panels are only a component of the structure and need to be combined with other site assembled structural systems to stand. The product most often does not integrate multiple trades in the manufacturing process. Because the system is panelized it ships very efficiently but it requires the same trades and basically the same time frame that a site-built custom home would take to fully finish. It is best applied as a single trade, structural and exterior skin solution with limited expectations for a factory finished interior. Because the panels are structurally limited and generally dependant on secondary systems such as column frames for joining they are also limited in dimension and result in great complexity in creating a weatherproof, code compliant exteriors.

As a result both panelized and modular means of construction have had limited applicability to complex or custom projects. Their application has most widely been applied to ubiquitous structures, temporary building where speed and low cost, but not quality, customization or durability, are primary. Because of this demand they are generally made of materials that are inexpensive and that allow for quick and easy assembly of the structure.

While pre-fabricated homes require much less site labor, they are targeted to be cheaper to build and buy as compared to the conventional site-built homes, and, as such, pre-fabricated homes are not widely applicable to the custom housing marketplace. Indeed, pre-fabricated homes are generally considered to be very basic "box" style buildings with little ability to vary character within a system. Within the parameters of a given methodology or system, the pre-fabricated homes tend to have very limited design options that significantly alter both the form and character of a product. Building sites that are most suitable for pre-fabricated homes tend to be limited to those that are easily accessible and with simple, flat or very gentle topography. In other words, home sites that can only be accessed via narrow roads, gates, under low overpasses, or that are on sloped sites are very challenged for the current methodologies for pre-fabricated homes.

Accordingly, it is clear that while existing technology in pre-fabricated modular or panelized homes do have certain advantages, there are still also many unsolved problems and execution difficulties associated with such homes. Thus, if pre-fabricated homes were able to have significant improvement of quality and features, these homes would have greater acceptance by a growing segment of the residential marketplace and realize a significant efficiency both economically and environmentally.

SUMMARY OF THE INVENTION

Accordingly, the present invention creates a fully finished manufactured unit and assembly where all the trades are integrated (structural, mechanical, plumbing, electrical and finish) in the manufacturing process, so that the design, production, manufacture and delivery of personalized living environments that ary highly customized to a specific site and client. The present invention accomplishes this by utilizing a unitized assembly and various assembly joineries to form a unique environment that is created by and for the homeowner. The system and process together create a dimensionally flexible custom home that is weather tight, universally code applicable, and transportable to the most challenging of site conditions and locations.

The unitized assemblies are both fixed and flexible in dimension depending on the graining of the unit. They are trade-integrated modules in unitized, shippable configurations. The module dimension where units are connected to each other are fixed, and the alternating grain or dimension is flexible. The unitized assembly is designed to achieve a high-craft finished quality and unmatched dimensional flexibility in both the vertical and horizontal planes. The unitized ceiling wall and floor assemblies are able to be joined and sealed effectively with the combination of a universal split column, drop column insert and rigid stacking stud integrally incorporated within their construction. The drop column inserts are rotating connection pins that allow for the simple assembly of the units and columns with other unitized assemblies and/or assembly joineries. This construction, manufacturing, and assembly system solves the above-mentioned building issues by creating fully integrated, fully finished "units" that are shippable. As a result, the ultimate building expression and enclosure is no longer limited to the size of road clearance less a flat bed or a shipping container, it is only limited by the imagination and aspirations of the homeowner.

The assembly joineries and connection methods permit fully integrated and fully finished modules to be transported cost effectively and allow for virtually unlimited interior height (up to 40' clear). The current prefabricated modular systems are limited to approximately 10'-0" finished ceiling height in a single module. The assembly joineries provide dimensional freedom, efficient strength to weight ratios, and expressed or stylized configurations in a variety of hybrid materials.

The unitized assemblies, assembly joineries and connection methods allow for proper architectural proportion to be the determining factor of exact room dimension. This is expressed through the use of a proprietary proportional algorithm. The proportional algorithm is a three dimensional fixed snap system that is generated by the specific conditions found in each of a number of various collections and ensures a proportion of length, to width, to height that configures a volume of a space elegantly.

The architecture of the overall system and complimentary passion profile process allows for the customization and personalization of the living environment. The process architecture (or integrated, comprehensive system) includes a detailed human factors behavioral analysis, as well as the design and construction of the physical unitized assembly. Taken together, these two process steps feed into an experience blueprint for the consumer. The experience blueprint comprises three foundational aspects that specifically map out a consumer's journey and service therein from introduction through execution of a branded and customized lifestyle environment. The experience blueprint structures a process that creates a specific visualization that is equally part of a proprietary system and part of the individual in the form of a passion inspired product collection. Through the experience blueprint, the homeowner selects specific elements from a series of finished collections, that are assembled by the proprietary assembly joinery system.

Thus, the combination of a process for personalization and a fully trade integrated fixed and flexible "unit" with flexible aesthetics and dimensions solves the long standing limitations associated with traditional house execution models, panelized or modular systems.

The present invention, including its features and advantages, will become more apparent from the following detailed description with reference to the accompanying drawings.

BRIEF DESCRIPTION OF THE DRAWINGS

FIG. 3 illustrates a chart featuring examples of behavior mapping within the human factors behavioral analysis, demonstrating the three aspects of the structured analysis: segmentation, characteristics and profiling, according to an embodiment of the present invention.

FIG. 4 illustrates a chart linking behavior analysis with physical expressions in categories of personal interests and passions, and as such demonstrates the connections between passion and product as they fit within the various collections and within the framework of the human factors behavioral analysis, according to an embodiment of the present invention.

FIG. 6 illustrates a chart of the experience principles within the experience blueprint that structures and identifies the moments that most matter in the process creating a personalized environment, according to an embodiment of the present invention.

DETAILED DESCRIPTION

Figure 1:
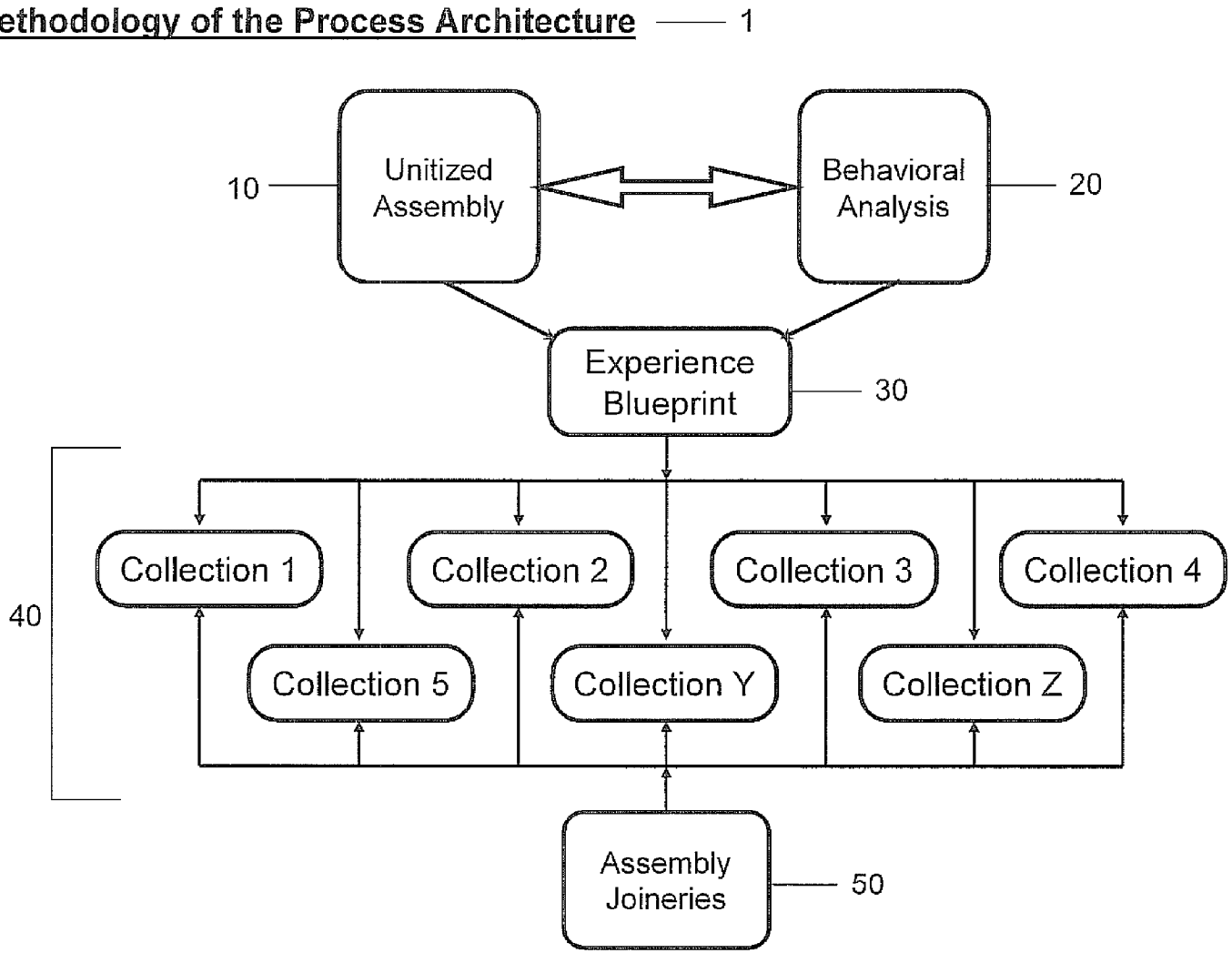
FIG. 1 illustrates a relationship chart of the methodology for implementation of the process architecture, demonstrating the important interrelationships between the physical systems and the emotions, behaviors, and experiences that consumers identify with themselves to create a personalized environment, according to an embodiment of the present invention.
Figure 2:
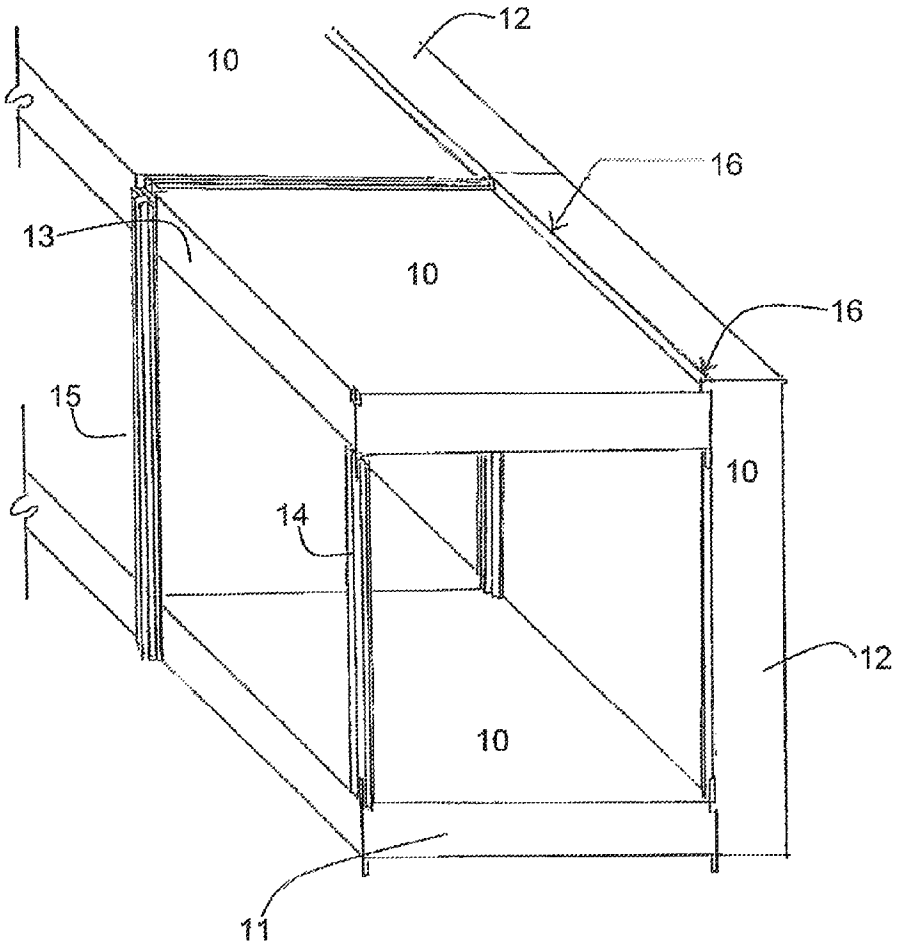
FIGS. 2(*a-f*) illustrates the primary physical features of the unitized assembly, according to an embodiment of the present invention.
Figure 2:
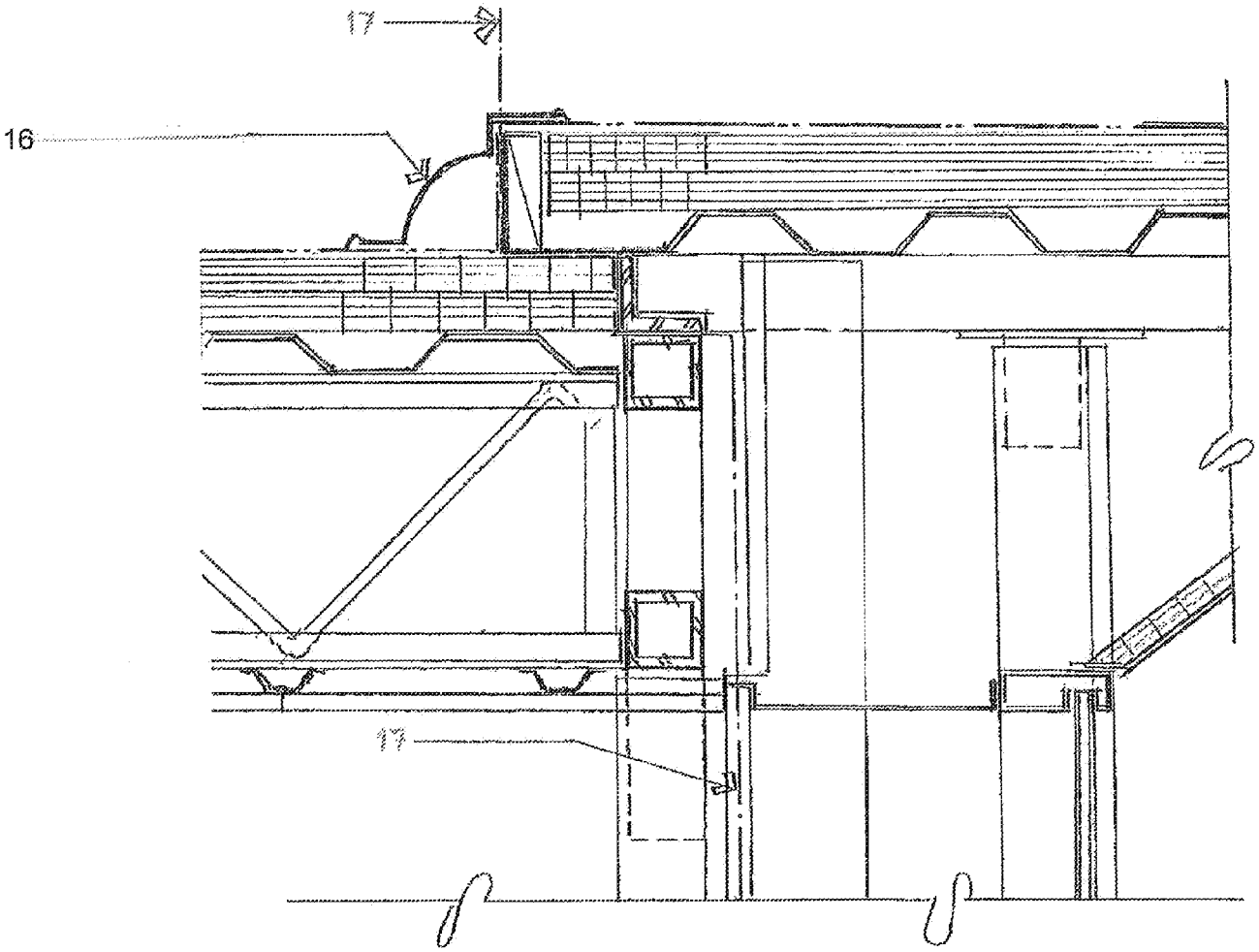
Figure 2:
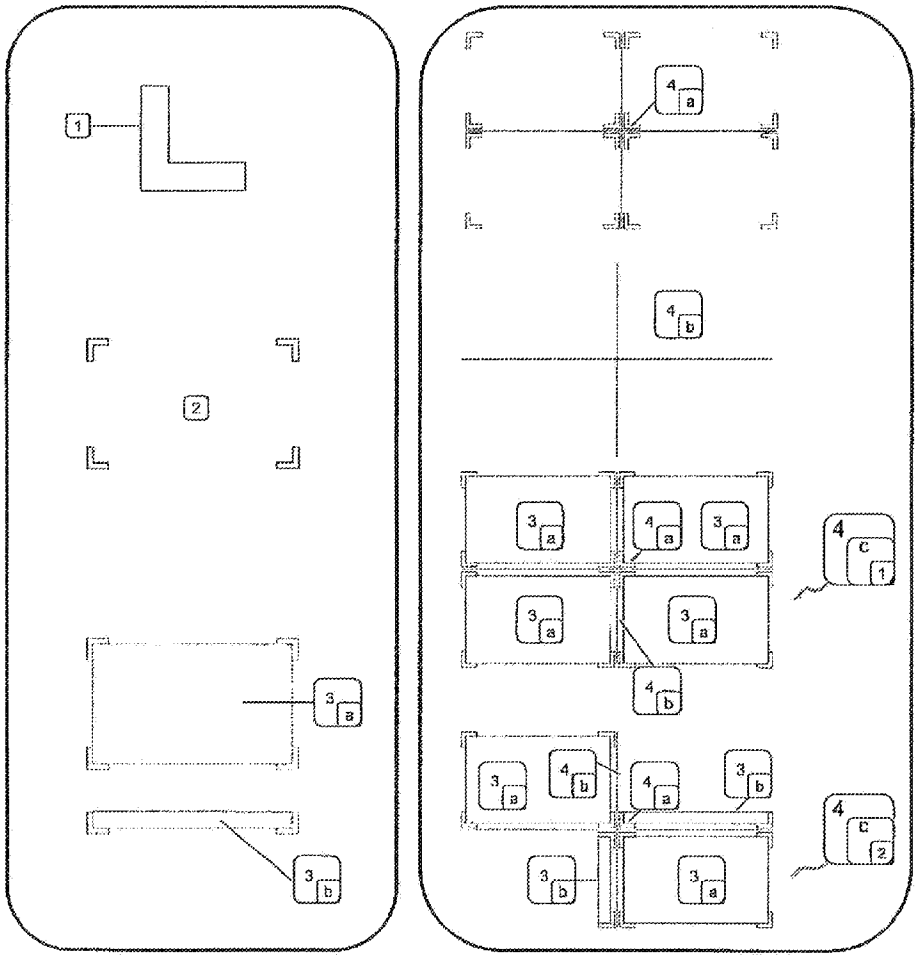
Figure 2:
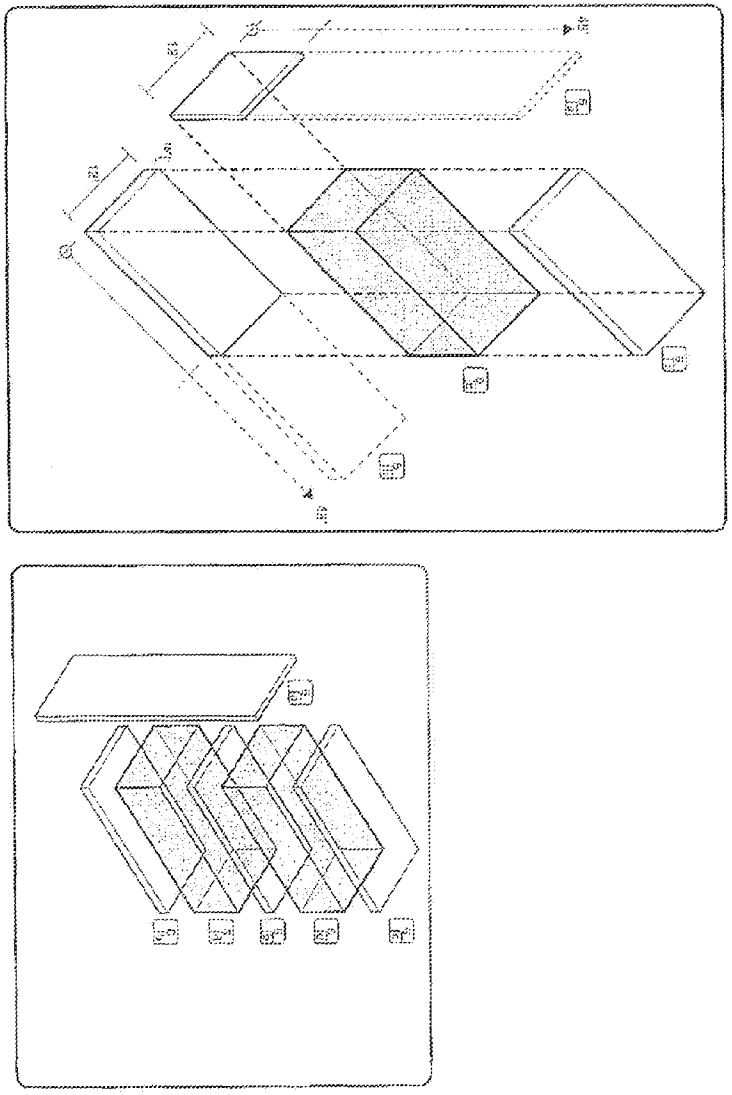
Figure 2:
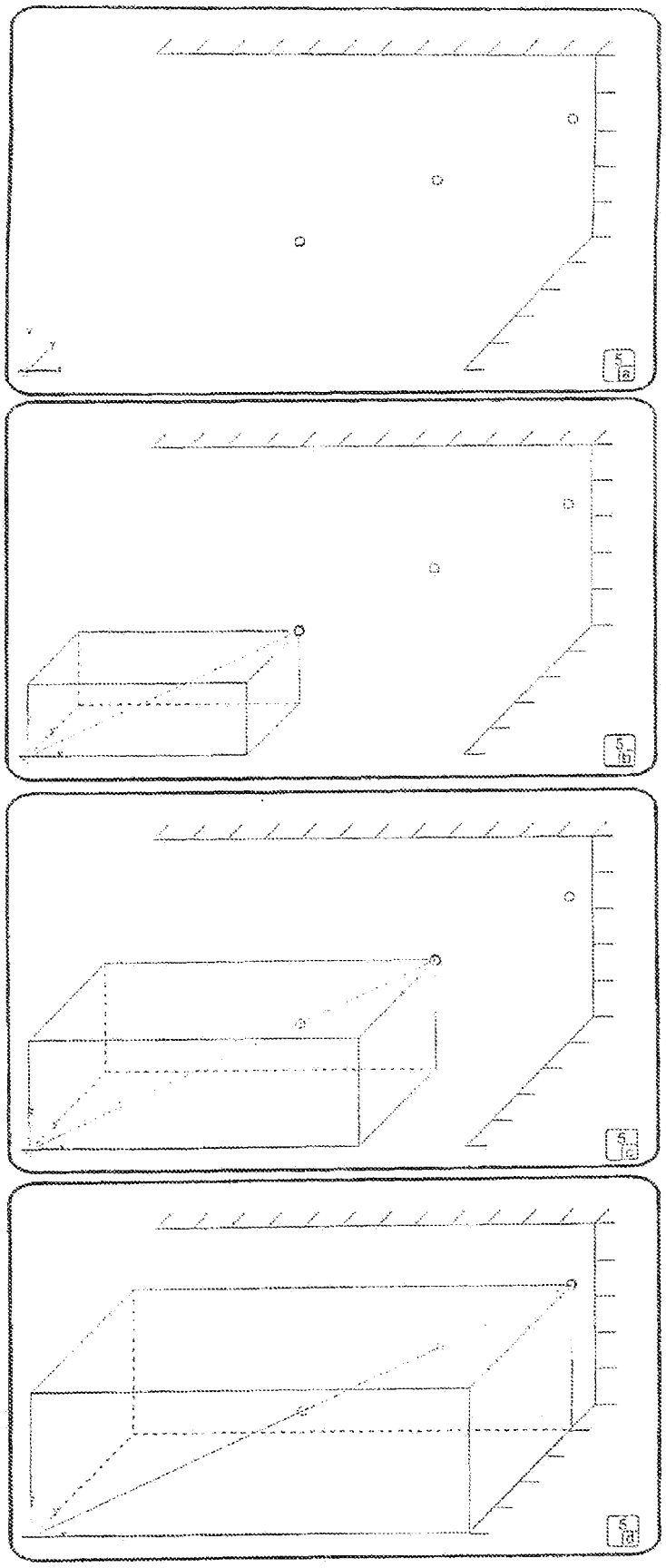
Figure 5:
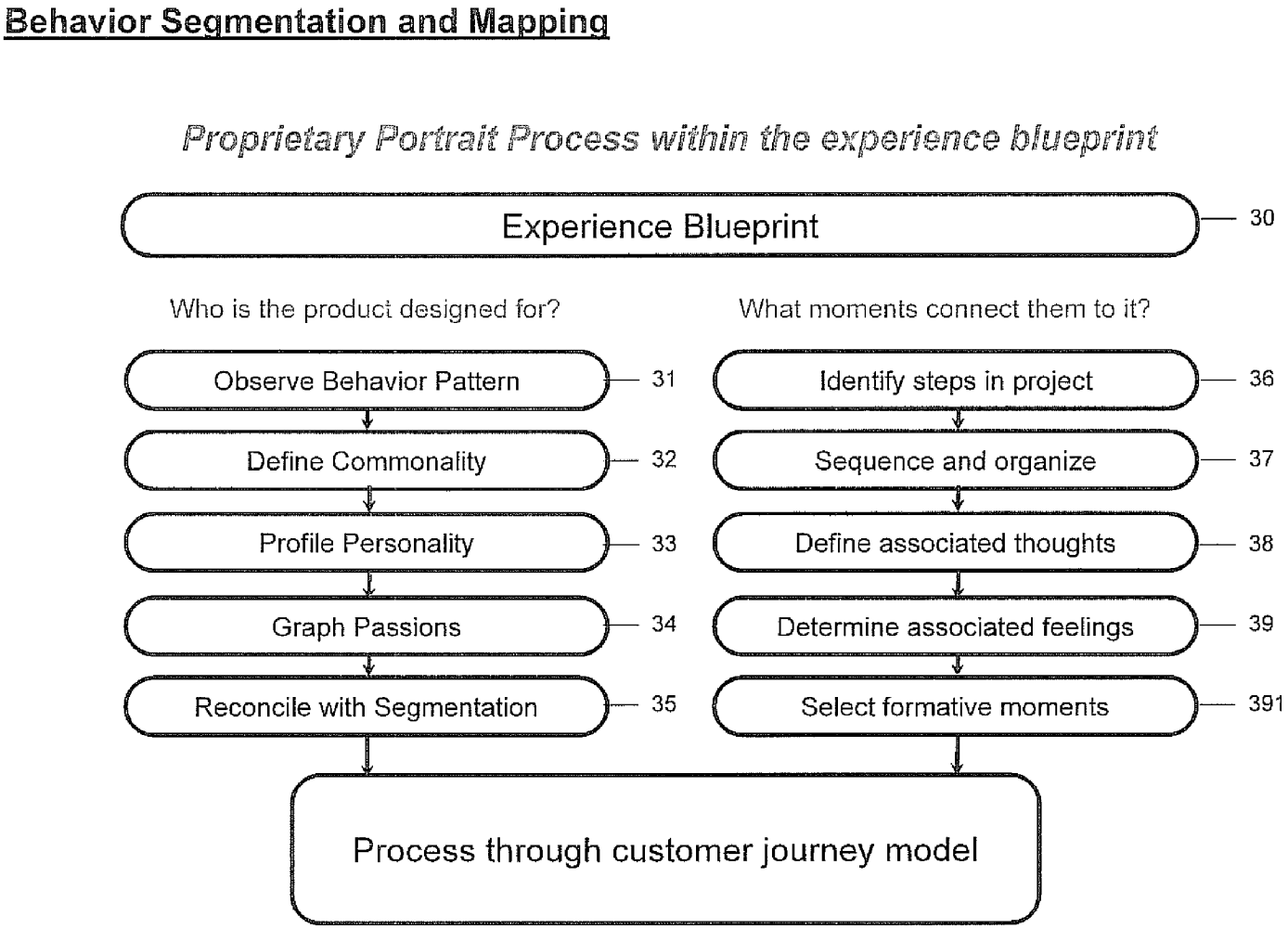
FIG. 5 illustrates a flow chart of a methodology for the implementation of the behavior segmentation and mapping process within the experience blueprint, according to an embodiment of the present invention.
Figure 7:
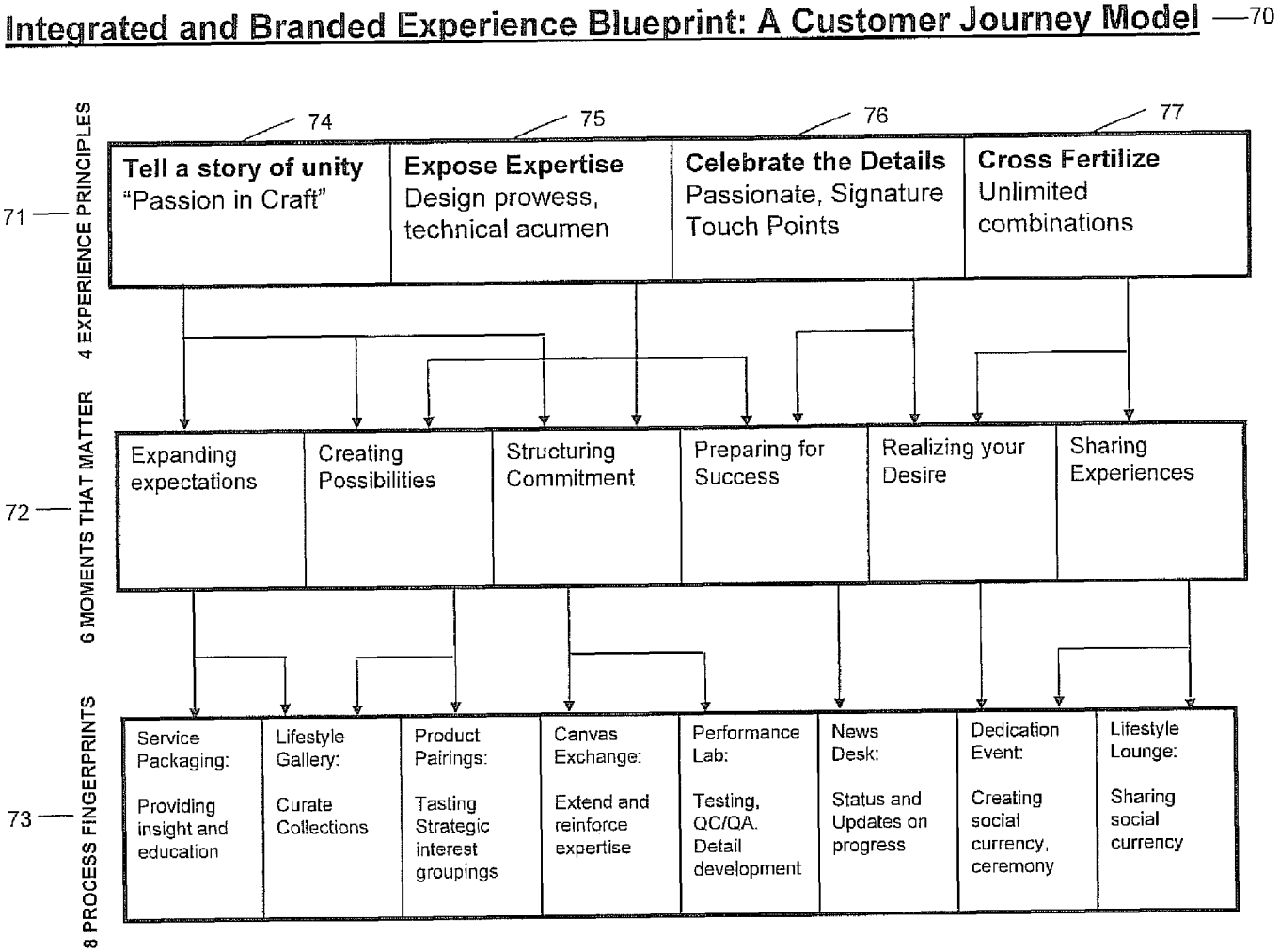
FIG. 7 illustrates a chart of a methodology for patterning a customer journey model within the experience blueprint, according to an embodiment of the present invention.
Figure 16:
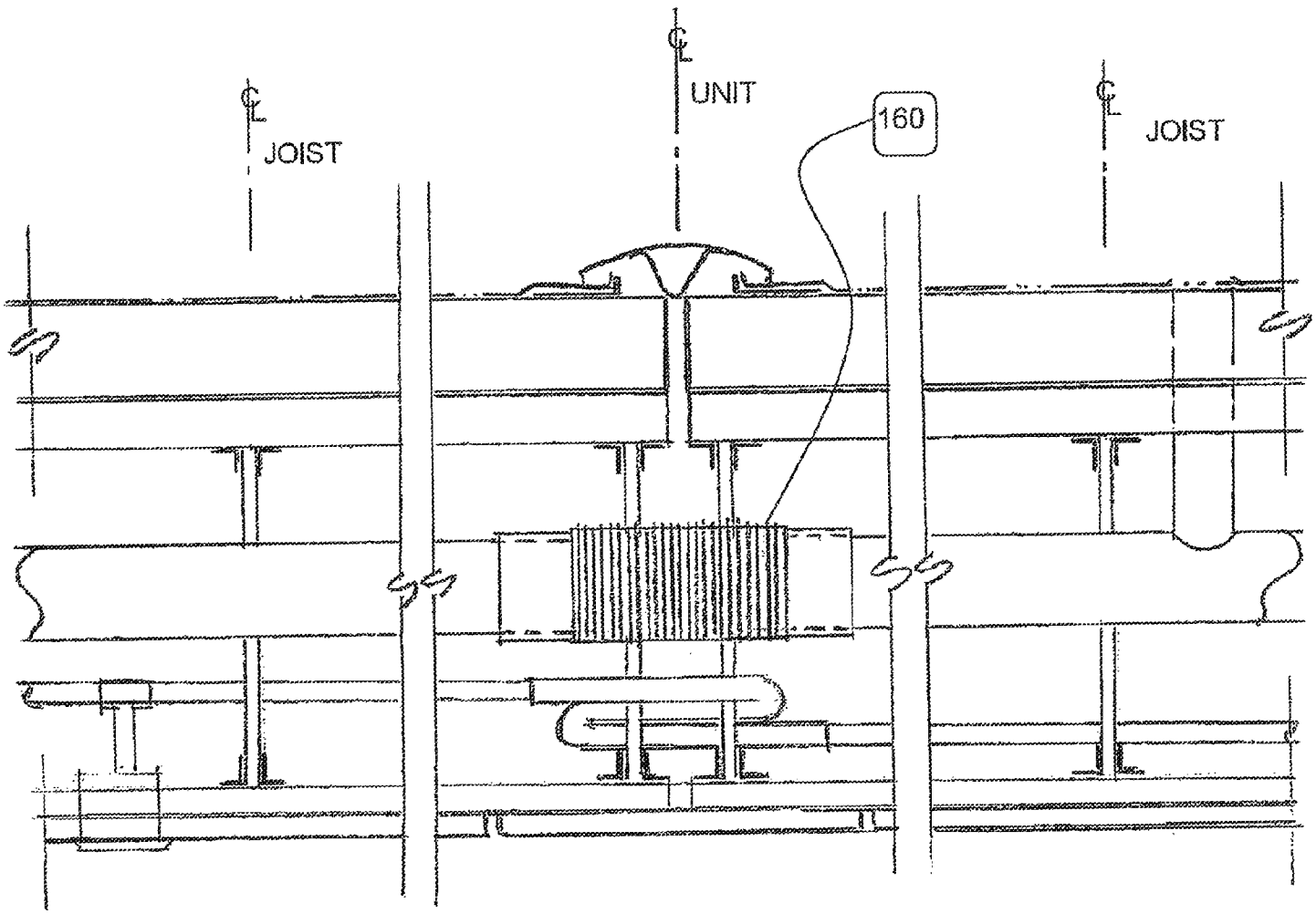
FIG. 16 illustrates a profile view of a MEP flex-joint assembly joinery (connector) for use between unitized assemblies permitting the movement associated with installation and external forces (e.g., earthquake and hurricane) to not effect the integrity of the installed and inspected systems, according to an embodiment of the present invention.
Figure 17:
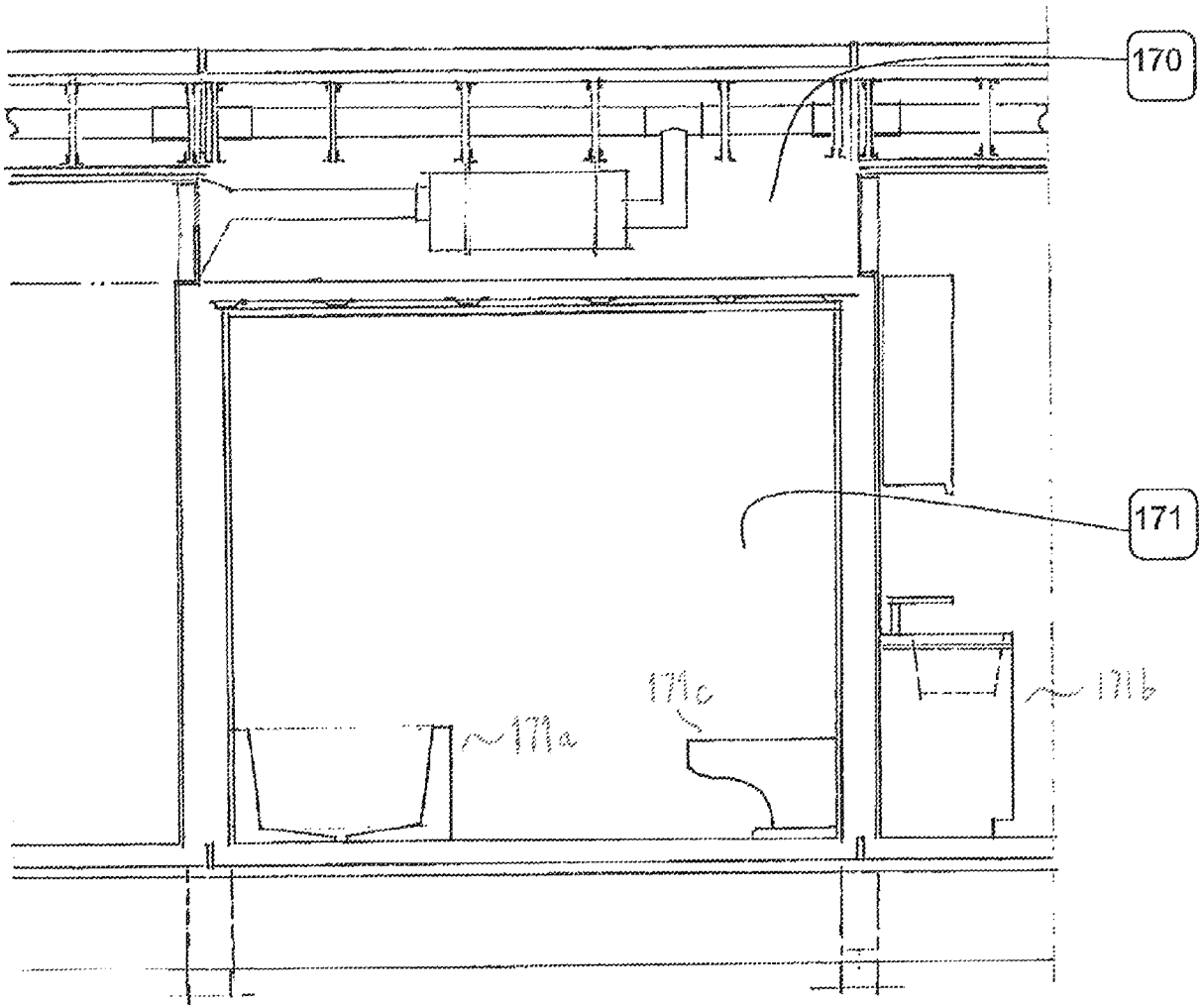
FIG. 17 illustrates a "green-bundled" system and a "wet-module" system with associated MEP assembly joineries, according to an embodiment of the present invention.
Figure 18:
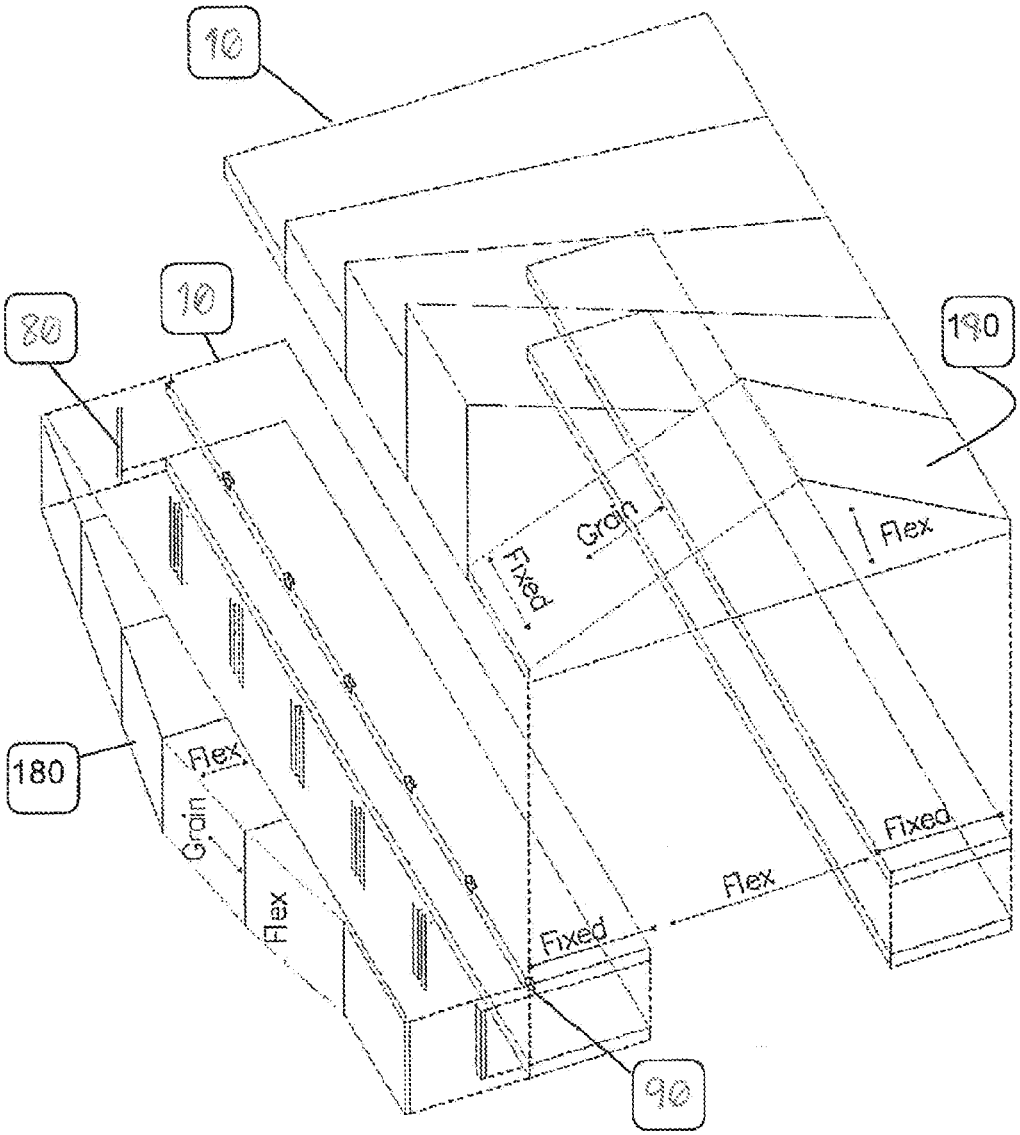
FIGS. 18 and 19 illustrate an exploded view and an architectural drawing, respectively, of the construction of an assembly unit with both fixed and flex assemblies, and wherein the diagram emphasizes the dimensional flexibility of both interior and exterior expression, according to an embodiment of the present invention.
Figure 19:
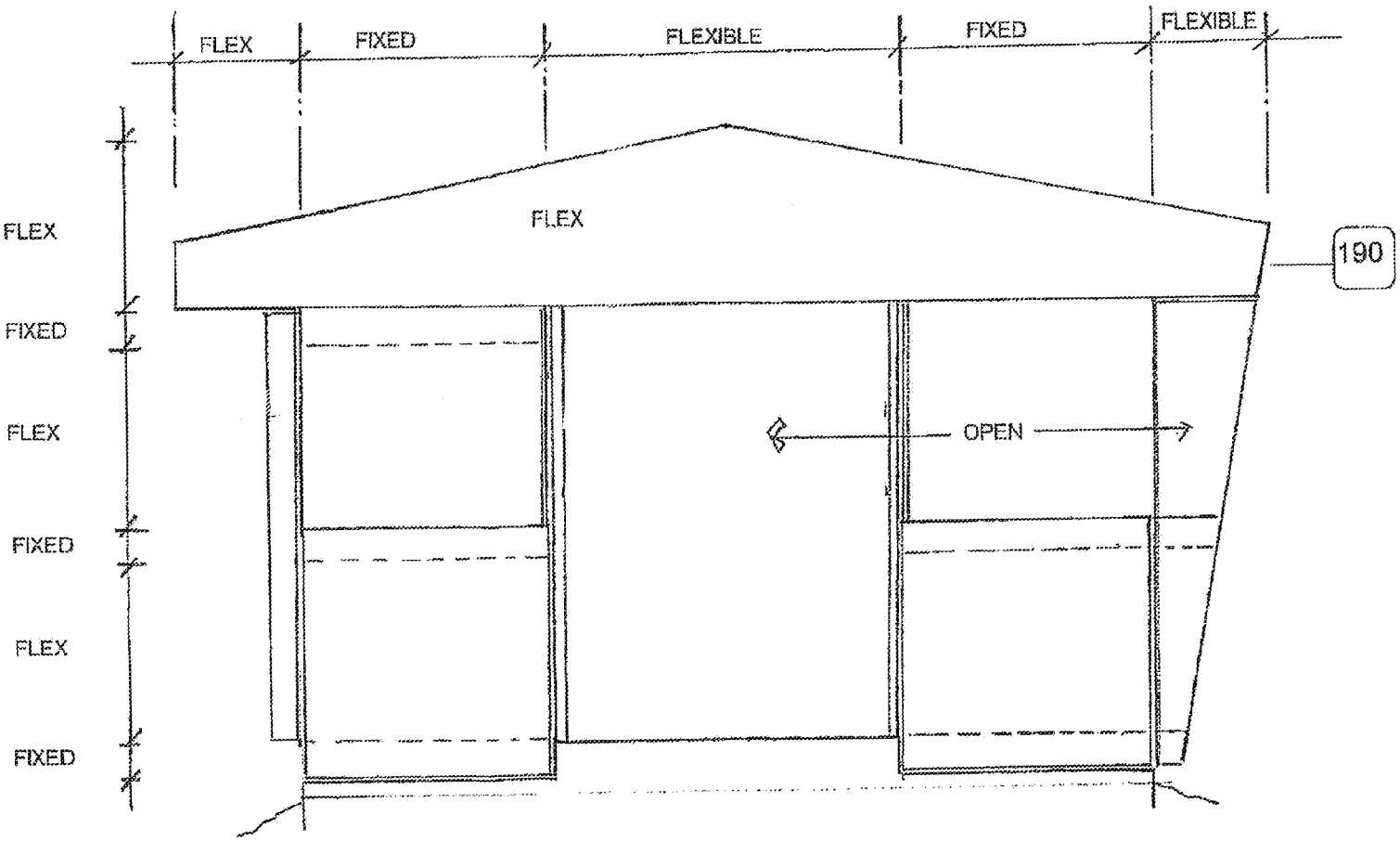

FIGS. 1-28 illustrate a method and apparatus for designing, producing, manufacturing, and delivering a personalized living environment. FIG. 1 illustrates the methodology and process architecture involved in creating the customized structure. FIGS. 2(*a-f*) illustrate the unitized assembly and its associated assembly joineries as they are utilized in the configuration and construction process. FIGS. 3 and 4 show the human factors behavioral analysis and the mapping of particular human emotions (i.e., profile), associating those passions (i.e., behaviors and desires) to the products (i.e., forms, textures and surfaces) as they are organized within the various collections. FIGS. 5-7 illustrate the customer experience principles and how they tie into the experience blueprint to describe and structure the customer journey from the beginning of the process to the end with a lifestyle portrait (or "Canvas"). FIGS. 8-15 illustrate the various proprietary unitized assemblies and assembly joineries, utilized in forming the finished expression (i.e., size, volume, shape) of a personalized living environment. FIGS. 16 and 17 illustrate critical methods by which the assembly systems join complex conditions where extensive infrastructure (i.e., plumbing, mechanical, electrical) or multiple trades (i.e., interior and exterior) are resolved to ensure a fully trade-integrated manufactured product that is weather resistive. FIGS. 18 and 19 illustrate construction of an assembly unit with both fixed and flexible assemblies. The combination of these two diagrams demonstrate the range in expression and configuration of the floor plan, the architectural section, the interior space, the exterior wall, the roofline and their individual proportions. Lastly, FIGS. 20-28 illustrate various universal columns and their signature collections that may be selected from. Each of these collections are specifically related to behavior characteristic profiles and segmentations. They demonstratively make a concrete connection between design and desire, by literally and figuratively embodying a set of aesthetic principles that will connect a form, texture, material and color, to a certain behavior and emotion.

Referring now to FIG. 1, a chart of the methodology for implementation of the process architecture for designing, producing, manufacturing and delivering "personalized living environments" relates five interdependent parts of the journey: Unitized Assemblies, Behavior Analysis (Passion Profile); Experience Blueprint, Signature Collections, and Assembly Joinery. The process essentially begins with two co-dependant steps that initiate and then reinforce connections between personal interests, emotions and their associated visual expression. Although these parts make up a journey that is described in a general sequence, it is important to know that the process works with a person entering it at any point, just as long as every part of the exercise is eventually completed. The consistencies with which connections are made between "passions and place" allow the process to be open and interactive while still achieving a defined and personalized result. In Step 10, the unitized assembly is studied, selected, prioritized and configured to test large scale form making decisions according to and in combination with the conclusions of the behavioral analysis in step 20. The behavioral analysis is conducted to discover and profile the inner passions and/or desires of the eventual homeowner. It is a matrix organization associating active passions and behavior in profiles such as: being precise, technical and analytical, with characteristics of that profile such as: detail and team orientation, with segment categories: such as "A planner". This matrix overlays with the second step (shown in FIG. 4) that defines forms that correspond to the profiles and analysis, thereby weaving passion and place very early in the process.

The identification of the unitized assemblies occurring in Step 10 and the conducting of the human factors behavioral analysis in Step 20 interrelate with the "experience blueprint" in Step 30. The experience blueprint has three (3) foundational aspects, which are: 1) behavior segmentation and mapping; 2) experience principles; and 3) patterning of a customer journey model. Each will be described in further detail below. The experience blueprint structures a future homeowner's physical, emotional and behavioral journey through this process.

In Step 40 of the personalized living environments process architecture, various Signature Collections may be chosen from. This demonstrative set of detailed designs effectively associate visual expressions with personal interests at a detailed scale. By interrelating the large scale forms and gestures embodied in the Unitized Assemblies with behaviors, and then showing consistently powerful emotional connections at the detail level of joinery (column design) the strength of the process architecture is revealed. A person can work from the details to the emotions to the large forms; or a person can work from the emotions to details to the large forms; or a person can work from the large forms to the details to the emotions. As is shown in the Figure, there may be one or more Collections, depending upon various factors. For example, Collection I may be called "America's Cup", which is a sailing inspired living environment. Collection II may be the "Cabernet" collection, which is based upon a vineyard inspired living environment. Further examples may be Collection III which is a "Tour" collection, which is a City inspired living environment. Various other examples of the living environment collections may be a ritual inspired living environment named "Tea", or a theater art inspired living environment named "Biennalle". Various other collections may be based upon: speed inspired living environments, sportsman inspired living environments, country inspired living environments, or yoga inspired living environments. The collections presented are a representative set that addresses many behavior profiles, but others will be introduced over time as "hybrid" profiles are defined. Regardless of the individual types or variations of the multitude of collections, in Step 40 the homeowner through the experience blueprint of Step 30 is able to select, prioritize and personalize on the basis of the combination of the human factors behavioral analysis in Step 20 and in the flexibility of the unitized assembly investigated in Step 10, to customize to his or her own passions in a "personalized" living environment. As such, the various representative collections validate the ability of the present invention to support virtually unlimited, fully personalized visual expressions. The various Signature Collections will be discussed in further detail below.

In Step 50, assembly joineries are utilized to structurally join, seal, and finish the unitized assemblies identified in Step 10. These components and details maximize the flexibility and economy of the system as a whole. The assembly joineries will be discussed in further detail below.

Referring now to FIGS. 2(*a-f*), a unitized assembly 10 is shown. The unitized assembly is a module system that is both fixed and flexible, and is manufactured in configurations that are easily transported. The unitized assembly enables a fully finished, weather tight product for a highly customized home which is produced in a quality controlled factory environment. It allows for an extremely consistent, high touch, well engineered, and refined craft in the final installed product. The assembly creates a fully finished environment unmatched in dimensional flexibility in both the vertical and horizontal planes that is economically transported. Resultantly, it is able to be viably applied to and installed in the most challenging site conditions and location.

Specifically then, as is shown by the figures, the unitized assembly is a trade-integrated sandwich or unit in which all of the structural, electrical, plumbing, HVAC, low voltage, and all other internal home mechanicals and interior finish trades are incorporated in the unitized-factory built assembly system. Additionally, the exterior of the unitized assembly is such that it is finished, insulated, and code compliant. Construction of the unitized assembly incorporates both internal and external assemblies. The internal assemblies, applied to an interior floor and ceiling condition are completed with finished trades, such as carpentry, tile, carpeting, wood, cir stone. The substrate is constructed of concrete and can provide code compliant fire resistance between floors. The external (i.e., wall and roof) assemblies can have ceiling finishes to the interior and roofing or thermal and moisture resistive surfaces to the exterior. In the vertical wall application the interior would again be the selected interior finish and the exterior would be the selected exterior material such as wood, stucco, stone, metal, or glass The unitized assemblies, as exemplified in the FIG. 2(*a*), are constructed as concrete substrates on a steel frame 10 that are preferably 11-4" to 8'-0" in width, 12'-0" to 42'-0" in height, and 8' to 42' in length and that incorporate both interior mechanicals and exterior finishes in final form. As shown in FIGS. 2(*a*) and 2(*b*), each unitized assembly 10 is fitted together by means of an interlocking seal 16 (or commonly known as a lap joint) when exposed to the exterior as to create a weather tight enclosure as between the Unit Separation Line 17. For example, if a unitized assembly 10 were designated as a roof-ceiling sandwich piece 11, it would be sealed to the wall unit 12 via interlocking seals 16. Ceiling piece 13 would be supported on the one side by the wall piece 12 and on the other side by columns 14 and 15. Column 14 is a ½ Universal Column without pairing, while Column 15 is a fully paired column. The columns would be fitted and secured onto the unitized assemblies 11 and 13 via drop column inserts. Drop column inserts would be fixed to the unitized assembly and capable of being rotated into a slot of the unitized assembly for shipping purposes, while rotated out for assembly. The drop column inserts, one of a number of assembly joineries 50, are described in detail further below. It is to be understood, of course, that while this is a preferred embodiment, it is not the only embodiment.

As shown in FIGS. 2(*c*) and 2(*d*), the unitized assemblies are universal which allows the graining of the unitized assemblies to be placed in vertical or horizontal direction. Structural Angle 1 acts as the basic element of the Unitized Assembly 10. When two or more of the Angles 1 are brought together they create a physical place 2 for the human factors behavioral analysis (described in detail further below) to be expressed. When the units are joined a 4 piece column is formed as a universal and fully resolved visual intersection of parts (the joining of the unit modules when completed are not apparent versus conventional modular construction that results in double columns or double walls where modules join). The combination of the Unitized Assembly 10 and the human factors behavioral analysis act together to define a volumetric space 3*a* and a dimension of the vertical or horizontal building component system 3*b*. The column/unit assembly defines a space "within" which the emotions and desires defined in the behavioral analysis can live. Additionally, such combination allows for significant flexibility as shown by the various sizing of Unitized Assemblies acting as a wall 6*a*, a floor/ceiling 6*b* and a ceiling 6*c*, with resultant space volume 6*d*. The assembled combinations, structured around universal column 4*a*, create an underlying geometry 4*b* that translates into a Proportional Algorithm. Two examples of such are shown as 4c.sub.1 and 4c.sub.2.

As shown in FIG. 2(*e*), the Proportional Algorithm is integral to the unitized assembly design and is generative for the architectural volume of the finished living environment. The algorithm determines an idealized height, width and depth of a space or form. The algorithm avoids mistakes in determining the height of a room given its footprint. It ensures an architectural and spatial quality for a personalized lifestyle. The dimensions of the Unitized Assemblies 10 is based upon the Proportional Algorithm being a three dimensional fixed "snap" system. The base fixed "snap" system Sa shows the three dimensional aspect, that is, length "x", height "z" and width "i". A preset "small" snap Sb, a preset "medium" snap Sc and a preset "large" snap Sd are available at the various dimensions and can be generated based upon conditions required by the various Signature Collections.

Accordingly, the unitized assembly can be fabricated or constructed anywhere in the industrialized world, and transported via rail or shipping container to anywhere else in the world. As shown in FIG. 2(*f*), each Unitized Assembly 10 can be easily transfigured from shipment-ready form 111 to construction-ready form 112. While the fixed stud 111*c* is fixed to the floor/ceiling assembly 111*a*, the flip stud 111*b* rotates. This flexibility is allowed by the configuration of the drop column insert assembly joinery and the rigid stacking studs assembly joinery (each of which will be described in detail below). Unitized Assemblies 10 placed together in a trucking configuration 113 allows for easy placement in shipping or rail containers 114 and indicate a protective space between the units made by the rigid stacking studs.

Referring now to FIGS. 3 and 4, the human factors behavioral analysis of Step 20 of the methodology of the process Architecture 1, is a process and experience designed to allow a homeowner to create "lifestyle portrait" for him or herself. The behavioral analysis is about connecting the homeowner's passion(s) to the environment in which they live. In so doing it creates personalized living experiences that are inspired by the desires and/or aspirations of the customer's interests. Those interests are essentially dimensionalized into aesthetic, lifestyle themes.

Referring now specifically to FIG. 3, a chart is illustrated that features examples of behavioral mapping within the human factors behavioral analysis context, to describe, refine and profile the homeowner's active passions. Varying active passions are listed under Column 1. Likewise, under Columns 2 and 3 the behavioral profile and behavior characteristics of the homeowner, respectively, are categorized as they relate to the active passion listed in Column 1. The organization of this matrix permits an efficient analysis of likes and dislikes in and around the behaviors. For example, if a homeowner tends to be a more focused, intense, unrelenting person, as described under the behavior profile Column 2, or has the behavior characteristics of being performance oriented, urban, and patterned, as described under the behavior characteristics Column 3, then the homeowner is more likely to connect with (from a perspective of associating that person's emotions and desires to a living environment) a "cycling" inspired form. Also for example, if the person has the behavior profile of that seen in Column 2 as being a caring, nurturing, caring or patient person, or has the behavior characteristics associated of Column 3 of an organic, seasonal or timely person, then he or she will be considered as best suited to the emotions evoked by a "country living" inspired forms. It is to be understood, of course, that the listed active passions and the behavior profile and characteristics that describe the passion can evolve and change as experience and time dictates.

Further, in Column 4, the behavior characteristics and profiles are segmented into behavior categories into which the homeowner may fit. For example, from the figure such categories are: "planner", "explorer", "down-sizer", "up-scaler", "early adopter", etc. By way of further explanation: the "explorer" is a person who seeks to discover new places, styles, and cultures; the "ex-urbanite" is a person who is urban at their soul but left to find solace elsewhere; the "down-sizer" is suburbanite who wants to reconnect and be more flexible in their lifestyle; the "up-sizer" is a upwardly mobile aspirational person who seeks to define an expanded lifestyle adding dimension to their current pursuits; the behavior segmentation category of the "early adopter" is the discontent, performance oriented person who needs the latest and greatest on the cutting edge; while the "planner" is the purposeful groomer of lifestyle features and intent. Likewise to Columns 2 and 3, the behavior segmentation of Column 4 is categorized to the active passion of Column I. However, these behavior segmentation categories can be independent in and of themselves or can be linked to the various behavior profiles seen in Column 2 and/or the behavior characteristics seen in Column 3. Thus it is to be understood that the matrix organization demonstrates cross associations of passions, behavior patterns, profiles, and categories.

Referring now specifically to FIG. 4, as the purpose behind the human factors behavioral analysis of Step 20 of the methodology of the process Architecture 1 is to map (i.e., categorize and accept) the homeowner's behavior(s) to the homeowner's passion(s) and thus connect them into a lifestyle Signature Collections, demonstrative connections of the consumer's mapped desires to that of the passion of the product in place (i.e., home) to be built can be reviewed and discovered with the consumer. A homeowner who maps into an active passion of "sailing" motif of Column 1 in FIG. 3 would be initially connected to the "America's Cup" Collection as shown in Column 1 of FIG. 4. The dynamic of such Collection can then be reviewed with the homeowner to confirm their understanding and compatibility. Columns 3, 4 and 5 show, respectively, the Collection's mood, construction elements and materials. For instance, as can be seen from the figure, the "America's Cup" Collection espouses the mood of a crisp, fresh, refined, light, movement, and thus is composed of the elements of a mast, sail, turnbuckle, and staywire, and will have the materials of canvas, shingles, teak, polished steel and cable. Likewise the "Hunt" Collection will evoke a more traditional mood and will have the elements of expressed frame, tiebacks, and tube steel, and have the materials of natural wood, planks and saddle leather. This combined structure between FIG. 3 and FIG. 4 illustrates how this particular method of analysis uniquely connects a person's profile with a set of environmental characteristics and ultimately architectural form. The "spirit" of the form is embodied not in the adaptation of a given style typically seen in housing (i.e., French Colonial), but rather in the details, textures and forms of the assembly and enclosure system as well as the ultimate expression of a fully composed, personalized home. The details and inspirations become integral to the design and construction process based on this unique connection of emotion to environment.

Referring now to FIGS. 5, 6 and 7, the personalization as defined through the experience blueprint of Step 30 and the methodology of the process architecture 1 is described. As mentioned above, the experience blueprint has as its basis three foundational steps. The first is the behavior segmentation and mapping, that codifies who the personalized living environment product is being created for. The second is the experience principles and criteria, that both define and enhance the consumds emotional connections to the product. The third is a patterning of a customer journey to structure moments in the project delivery process that reinforce a connection from the person's passion(s) to a place and a product to be constructed specifically for him or her.

Referring now to specifically to FIG. 5, the behavior segmentation and mapping process within the experience blueprint 30 is shown. The experience blueprint 30 has two parallel tracks which answer complimentary questions that in combination craft the customer's process through the customer journey model. The first question that is answered through the experience blueprint is: who is the product designed for? The second question that is answered through the experience blueprint is: what moments connect them to it? With regard to the first question, "who is the product designed for?", the experience blueprint details in step 31 to observe the customer's behavior pattern in both the virtual and physical environment. In step 32 to find commonality between desires and actions in the profiling process, in step 33 to profile the customer's personality by comparing both to visual and written analysis, in step 34 to graph the customer's passion(s) across the matrix to determine rules and expectations in their responses, and in step 35 to reconcile with the segmentation of the behavioral analysis 20. With regard to the second question, "what moments connect them to it?", the experience blueprint details in step 36 that the steps in the project are identified for a particular person depending on where they chose to enter the system. In step 37 it is sequenced and organized to ensure that the entire process is completed, in step 38 captures the associated thoughts as someone goes through their personal journey, in step 39 the associated feelings are defined and confirmed with visual cues of materials, lifestyles and collections, and in step 391 the formative moments are affirmed for a particular homeowner.

Accordingly, the experience blueprint 30 structures a process that creates specific visualizations that are equally part of the system and part of an individual, in a form of a passion inspired product and collection. In such manner then the experience blueprint specifically maps a consumer's journey and service model from introduction through execution of a branded and personalized lifestyle environment.

Referring now to FIG. 6, the experience principles and six moments of emotion that matter in the experience blueprint 30 within the context of the methodology of the process Architecture 1 is shown. Within the illustrated chart the questions: "steps: What to do?", and "Feelings: What to I feel?", are defined by six moments that matter. For each person the description of what happened at the moments that matter will change but the structure and sequence of the moments themselves do not. The moments that matter are: 1) expanding expectations; 2) creating possibilities in your passions; 3) structuring commitment; 4) preparing for success; 5) realizing your desire; and 6) sharing experiences. The six moments that matter are each individually correlated to the "what to do?" steps and the "what do I feel?" emotions. What to do? similar to The Collection is a form or expression of what I feel at the moment. This consistent association of form and feeling gives the system its underlying structure.

The process experience principles and six moments of emotion that matter shown by the figure help identify important steps and feelings associated with those steps to complete the experience blueprint and emotionally bind the customer/homeowner to the finished product. For instance, in the first moment that matters within the experience blueprint of Step 30, the moment of "expanding expectations", the steps that occur are the entry by the customer into the experience blueprint of the process that codifies the "design for desire' methodology of the process architecture and the corresponding customer feeling of anxiousness associated with such entry. This important step attempts to remove the preconceptions of previous projects that the consumer may have experienced and what now was possible. The second step that corresponds to the first moment that matters of "expanding expectations" is the introduction and the corresponding feeling of needed preparation. Such allows for recognition and identification of solutions or things that need to be done to assist the customer/homeowner along the journey disposing of specific concerns that may distract or hamper the strength of the analysis. As another example, the fourth moment that matters is the "preparing for success". Within this moment the corresponding steps thereof are the collection, segregation, and integration/synthesis. The emotions of confirmation and revelation are experienced through those steps. With the segregation of the collection comes the corresponding emotion of confirmation in the decision making process, while with the step of integrating and synthesizing the collection into the overall development comes the feeling of revelation of seeing the process falling into place and the result of your journey. The constant reinforcing of the interrelationship of emotions to forms, of desires and interest to the physical environment and vise versa comprise the unique and special experience that is personalization. In this case we create a system of personalization that brings speed, accuracy, flexibility and consistency to what is normally a process filed with anecdote and unpredictability.

Referring specifically now to FIG. 7, the customer journey model 70, of the integrated and branded experience blueprint of Step 30 of the methodology of the process Architecture 1, is shown. The customer journey model 70 has four experience principals 71 that lead into the six moments that matter 72 (as described with reference to FIG. 6) and eight process fingerprints 73. The four experience principals 71 are referred to as: "tell a story of unity" 74, "expose expertise" 75, "celebrate the details" 76, and "cross fertilize" 77. As can be seen from the figure of the customer journey model 70, the experience principals 71 may lead into more than one of the six moments that matter 72. For example, the experience principal of telling a story of unity "passion in craft" 74 is integral to the "expanding expectations" moment that matters, the "creating possibilities" moment that matters, and the "structuring commitment" moment that matters.

Likewise, the six moments that matter 72 then lead into the eight process fingerprints 73. The process fingerprints 73 detail various "points" in the product completion process and correlate to the particular one or more of the six moments that matter. For instance, with regard to the "expanding expectations" moment that matters the service packaging allows for a providing insight and education to the customer. Also for instance, with regard to both the "expanding expectations" and "creating possibilities" moments that matters the lifestyle gallery allows for curetting the various collections such that the customer may view the various possibilities checking, review and validating their reactions. Accordingly, the various process fingerprints 73 are specific implementable actions that assist in defining and realizing the six moments that matter for the customer/homeowner as he/she completes the customer journey model towards a personalized living environment.

Referring now to FIGS. 8, 9, 10, 11 and 12, the various assembly joineries 50 are illustrated. The assembly joineries 50 are utilized to support the various unitized assemblies and act as structural and finishing components. The use of the assembly joineries acts to provide efficient support strength to weight of the unitized assembly components and acts to further express the tailored configurations of the collections. The columns can be constructed of varying hybrid materials, such as wood/steel, stone/steel, chrome/black steel, or pre-cast concrete/steel. In such a manner the assembly joineries 50 provide for unique and personalized expressions of the various Signature Collections 40 within the methodology of the process Architecture 1 and maintain the integrity of the system as a whole.

Figure 8:
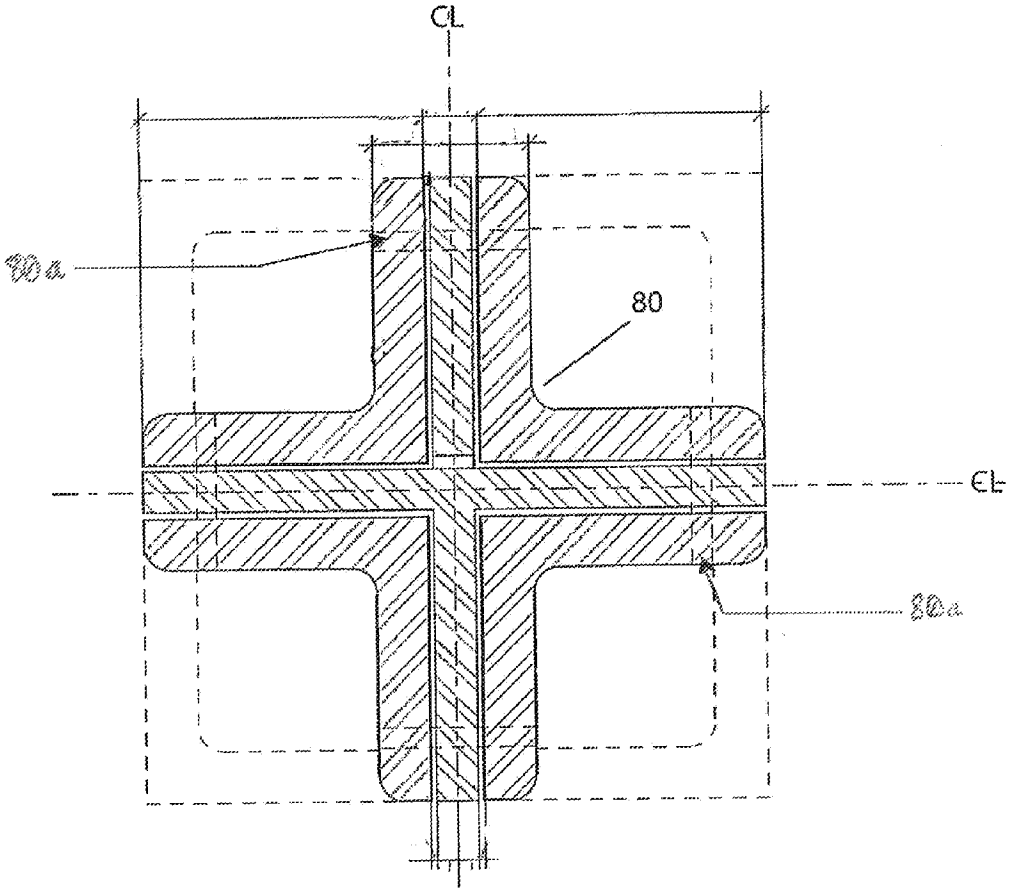
FIG. 8 illustrates a view of the universal column assembly joinery, comprising a four piece column where each leg attaches or is integrated into an adjacent unit; and as such it provides sufficient rigidity in its singular form to transport and erect and provides full capacity to resist gravity, wind and earthquake loads in its fully assembled, 4-sided configuration, according to an embodiment of the present invention.

Referring now specifically to FIG. 8, a universal column 80 is shown. The universal column is a two-to-four piece column that when assembled comprises two to four adjoining structural "L-shaped" angles around axis lines CL. The universal column 80 can be made in 4 parts for shipping stability of the fully assembled unit. Each of the quarter columns are rigid enough to fully support the shipping and erection processes. For construction purposes and when combined in a four sided configuration it creates a column that fully resists for dead load and/or live loads, and is compliant with earthquake and hurricane design criteria. The structural design of the universal column 80 allows for plumb and true mating with a drop column insert and/or rigid stacking stud (each described in more detail below). And each universal column 80 can have a vertical slot 80*a* for insertion of an anchor bolt (not shown).

Figure 9:
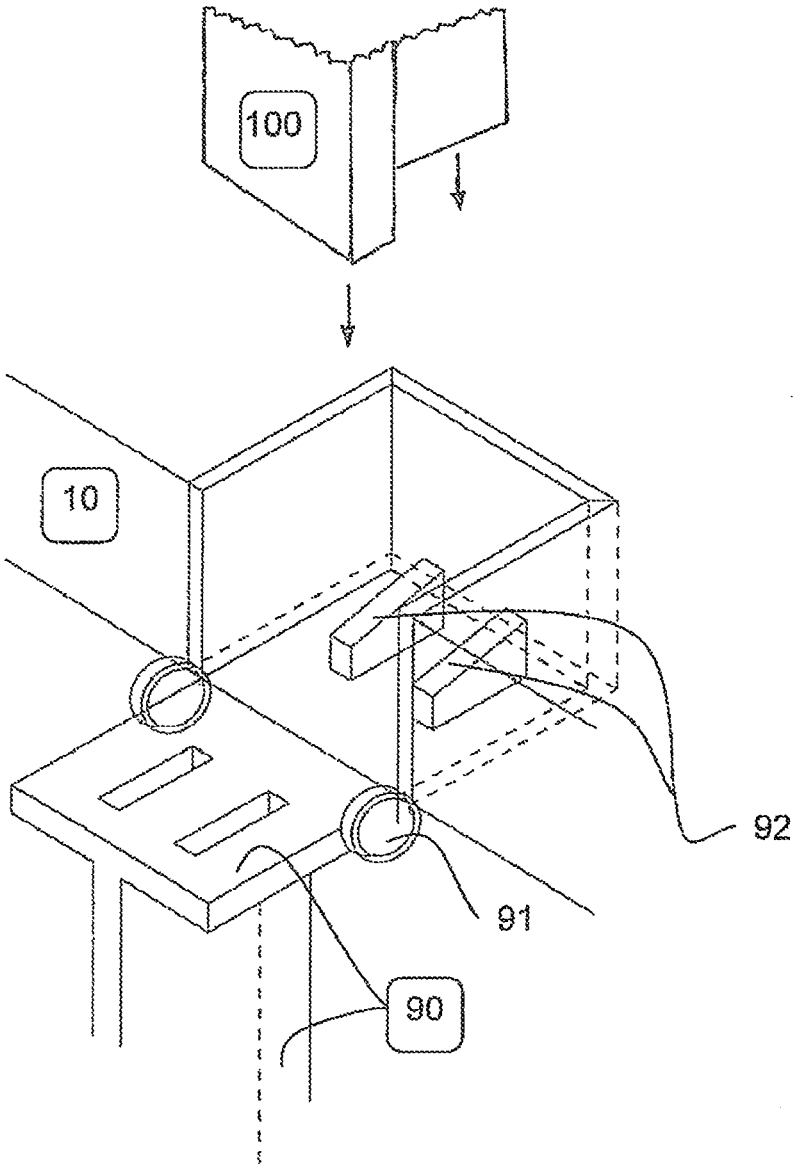
FIG. 9 illustrates a view of a drop column insert assembly joinery that creates a structural pin connection to the universal column and "drops" away to minimize shipping dimensions, and reinforce the edge of the unitized ceiling sandwich during transportation and erection, according to an embodiment of the present invention.

Referring now specifically to FIG. 9, a drop column insert 90 is shown. The drop column insert 90 is a column attachment bracket that rotates around a hinge point 91 on the unitized assembly 10. In a fully rotated "out" position the drop column insert 90 inserts into the universal column 80 and creates a structurally sound pin connection. In the fully rotated "in" position, the drop column insert 90 is locked open by stud 92. The two rotated positions of the drop column insert allow for connection to a universal column in one position and efficient shipping in the other. It is also to be understood that rather than a hinged connection point, the drop column can be slide actuated in and out of the unitized assembly. Either connection method when joined with the column results in a virtually unlimited height (within expected standards of the proportional algorithm), dimensionally true and nearly perfectly level erecting, and an efficient field assembly. Additionally, the stud 92 allows for fit to a rigid stacking stud (described in further detail below) in the shipping position.

Figure 10:
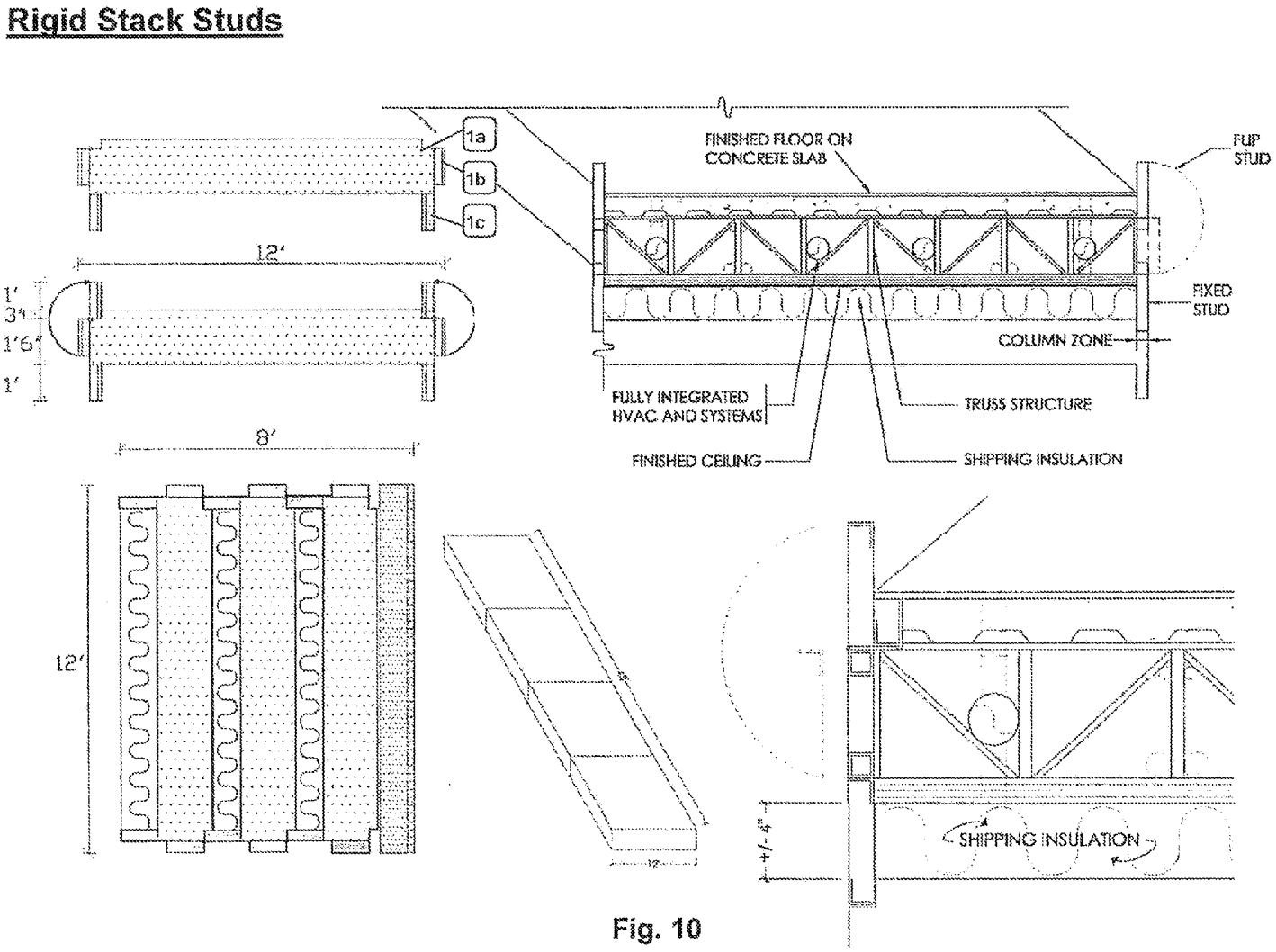
FIG. 10 illustrates a view of a rigid stacking stud assembly joinery, wherein the stud locks into the seat of the drop column insert to secure two unitized ceiling units during transportation and, along with the drop column insert, creates a rigid moment frame connection with the floor and ceiling units, according to an embodiment of the present invention.
Figure 11:
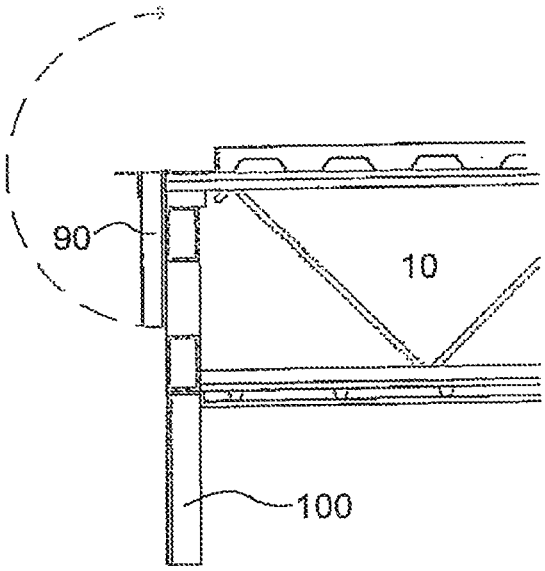
FIGS. 11(*a-e*) illustrate the mechanical operation of the drop column insert and rigid stacking stud assembly joineries and their integration with the universal ceiling sandwich, wherein the rigid stacking stud maintains a protective dimension between finished surfaces during shipping and erection, according to an embodiment of the present invention.
Figure 11:
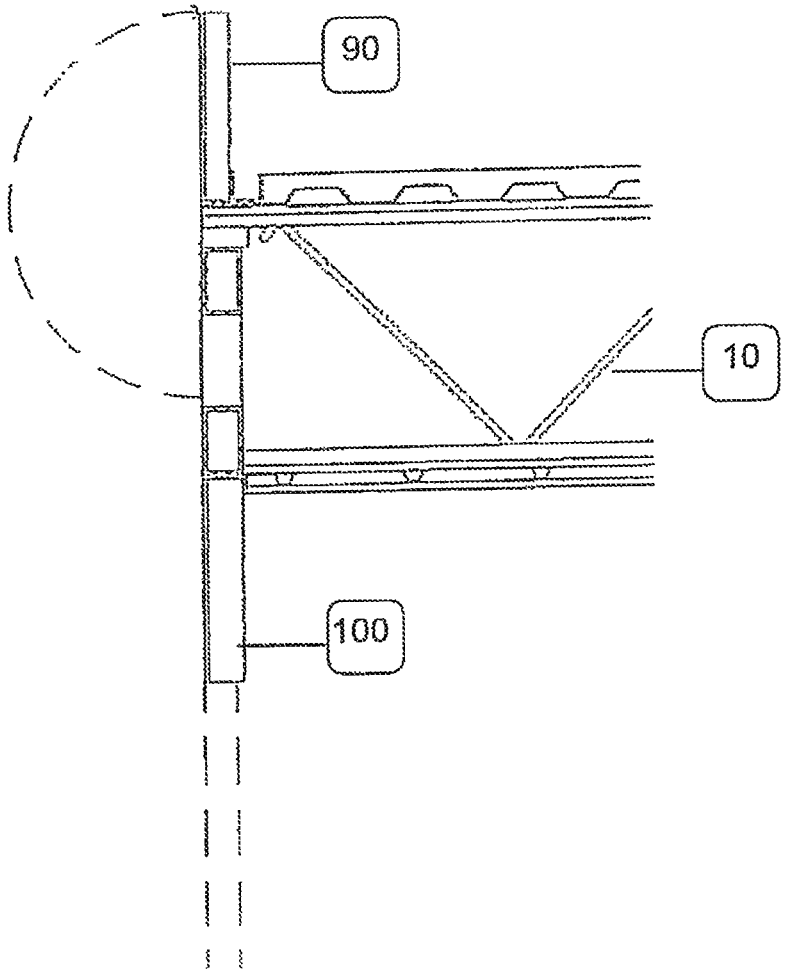
Figure 11:
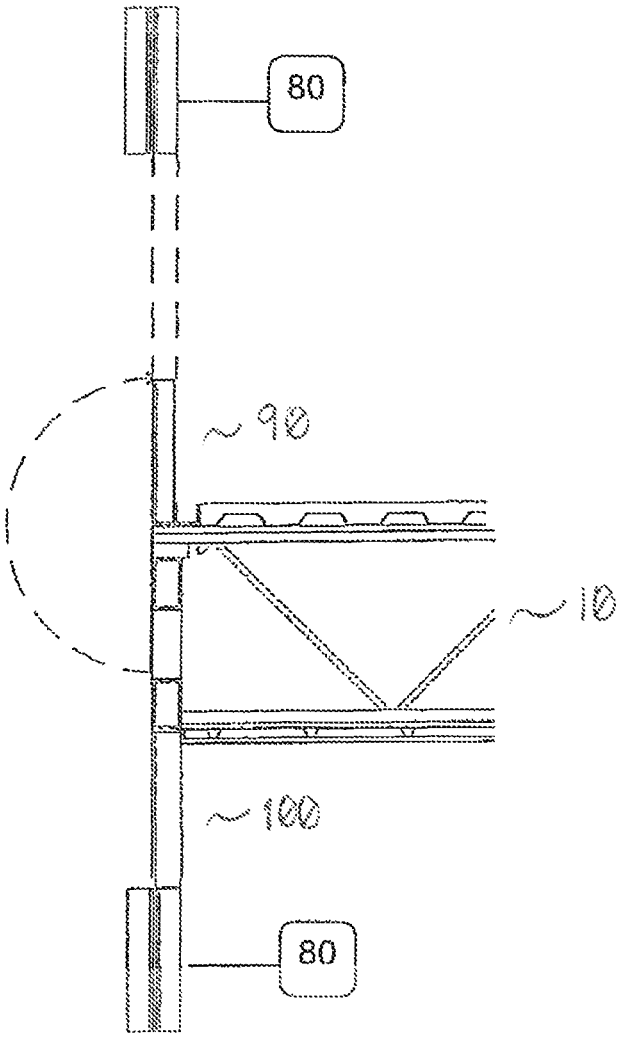
Figure 11:
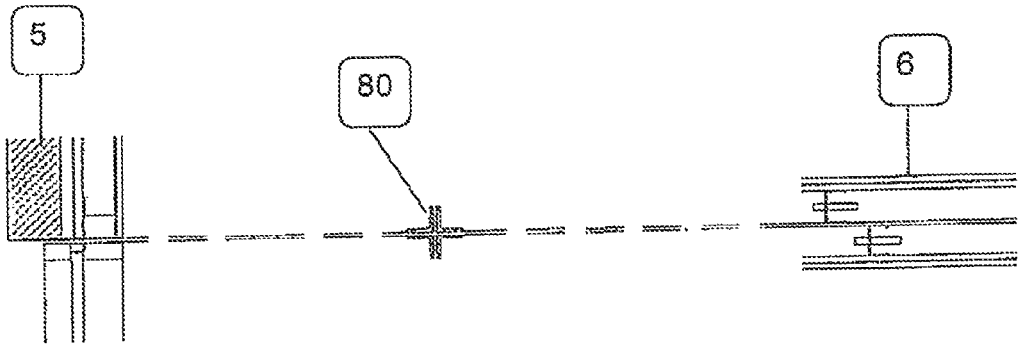
Figure 11:
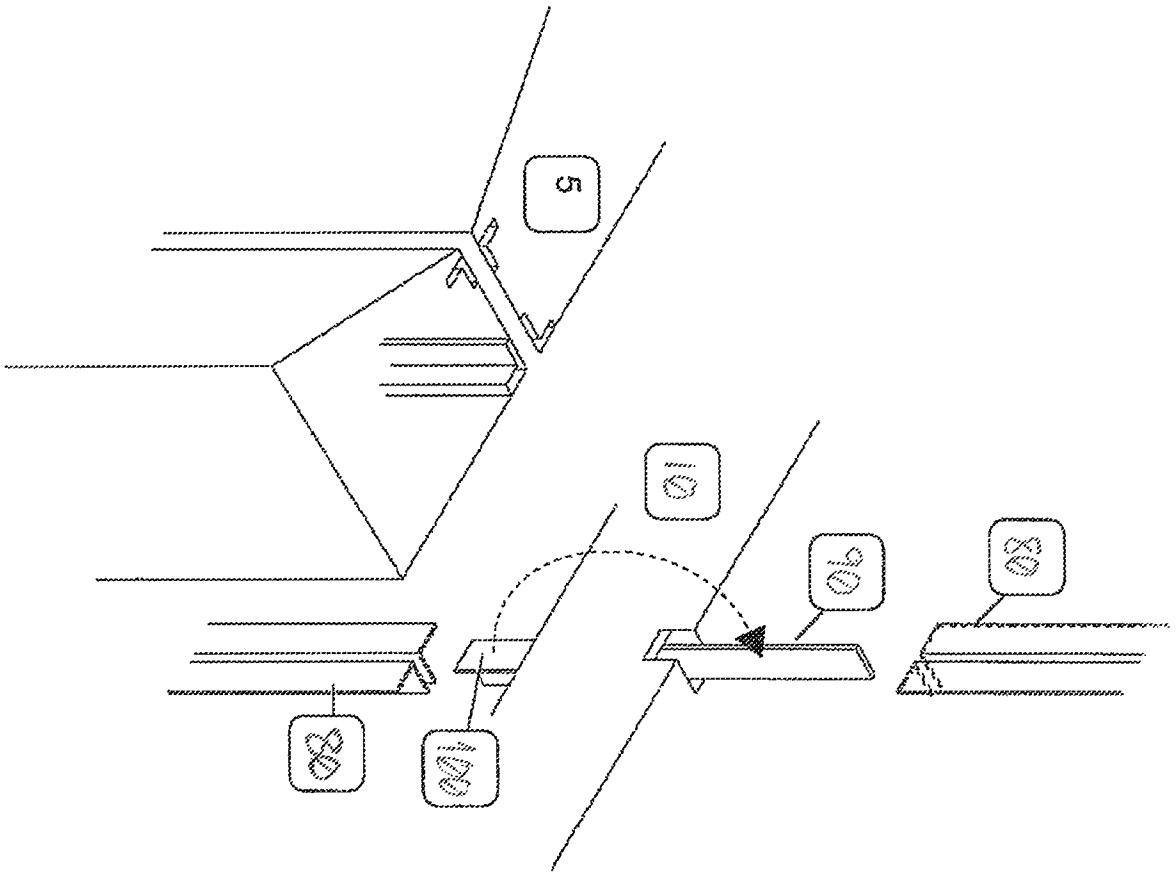

Referring now specifically to FIG. 10, the rigid stacking stud 100 is shown. The rigid stacking stud 100 is a fixed column connection integral with the unitized assembly 10. The fixed positioning of the rigid stacking stud allows for connection to a universal column 80. The connection may be by welding, bolting, or other means of fixing the rigid stacking stud to the unitized assembly. In combination with the drop column insert 90, as show in FIG. 9, the rigid stacking stud 100 enables a rigid column-slab connection making a moment frame capable of resisting hurricane and earthquake loads, ensures a plumb and true column installation, and permits a fully assembled and fully finished unit I the factory to be broken down into a fully protected shipping container format. In the shipping format the drop column insert is seated into the stacking studs 92. This stabilizes one unit to another for shipping and protects the finished floor, wall, or ceiling by leaving a 4" airspace between unitized assemblies Additionally, referring now specifically to FIGS. 11(*a-e*), the mechanical operation of the drop column insert 90 and the rigid stacking stud 100 on the unitized assembly 10, and then in combination with the universal column 80 is shown. Specifically in FIGS. 11(*a*) and (*b*), the rotatable operation of the drop column insert 90 in it's fully rotated "in" and "out" positions is respectively shown. Further, specifically in FIGS. 11(*c-e*), side, top and perspective views of the mechanical operation of the connection of a universal column 80 to either the drop column insert 90 or rigid stacking stud 100 are shown. As can be in these views, the universal column 80, in either it's two or four adjoining "L-angle" configuration slides onto the drop column insert 90 or rigid stacking stud 100, as the case may be. The combination of the unitize ceiling/wall assembly, universal column, drop column insert, and rigid stacking stud give the system great flexibility in terms of the physical expression (volume, texture, form) and great efficiency in transporting and erecting and fully finished trade integrated product.

Figure 12:
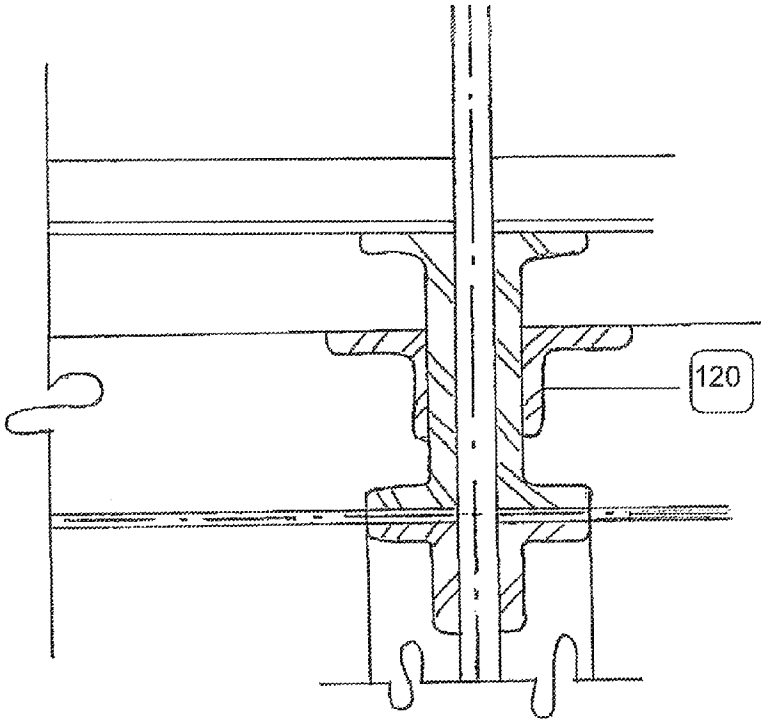
FIG. 12 illustrates a view of a universal split beam assembly joinery that marries to the universal column and joins two adjacent unitized ceiling sandwiches, according to an embodiment of the present invention.
Figure 13:
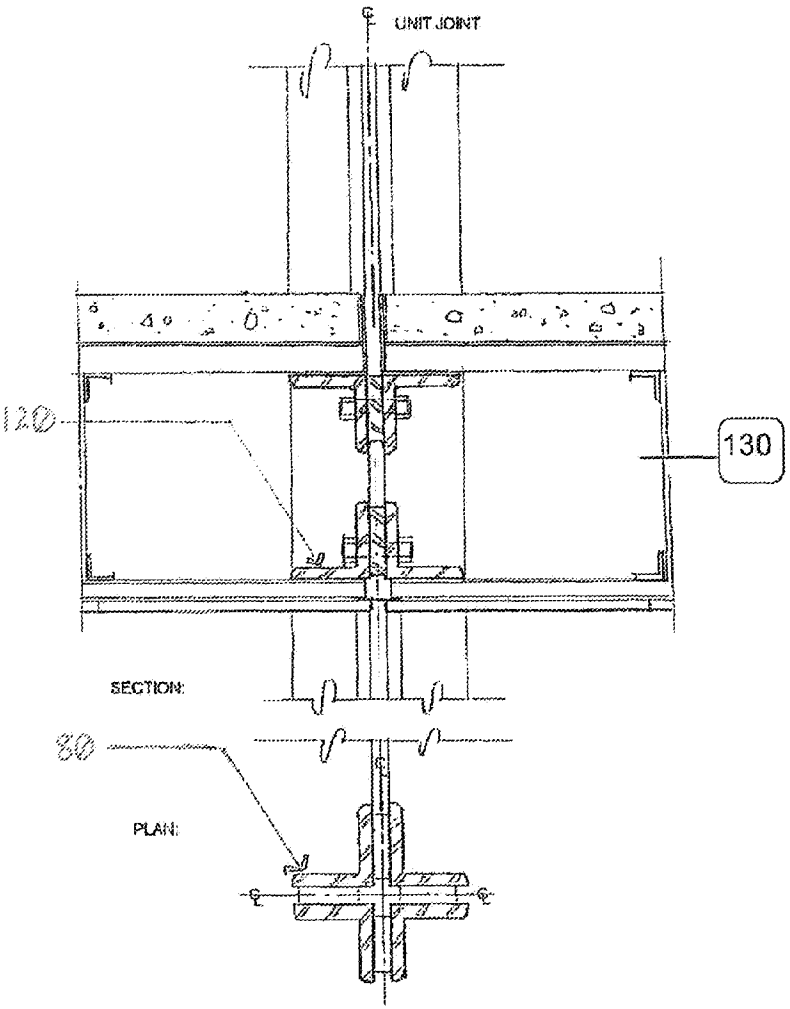
FIG. 13 illustrates a view of the composite column unit assembly joinery, it being such that the 4-piece universal column uniquely permits the integration of both wood and steel structural systems while maintaining the integrity of the system assembly and fabrication, according to an embodiment of the present invention.

Referring now to FIG. 12, a universal split beam 120 is shown. The universal split beam 120 is a two piece composite beam/joist that translates the universal column to a horizontal assembly and permits fully finished floor/ceiling/wall unitized assembly 10 "sandwiches" to be joined. The split beam marries with the universal split column for a rigid connection while allowing the ceiling and wall assemblies to oriented in either direction vertically or horizontally, around the module joints 120*a* and 120*b*, respectively, prior to assembly, Referring now to FIG. 13, a composite column unit 130 is shown in section and plan views. The composite unit 130 is a two piece column that is a composite construction of wood, heavy timber and/or fully finished exposed steel section in either stainless steel, chrome, or riveted finishes to deliver double story height. This is demonstrative of the flexibility within the system to integrate multiple building systems and materials. In this figure it is contemplated that a heavy timberwood column would be comprise one side of the universal column configuration and rise two stories.

Figure 14:
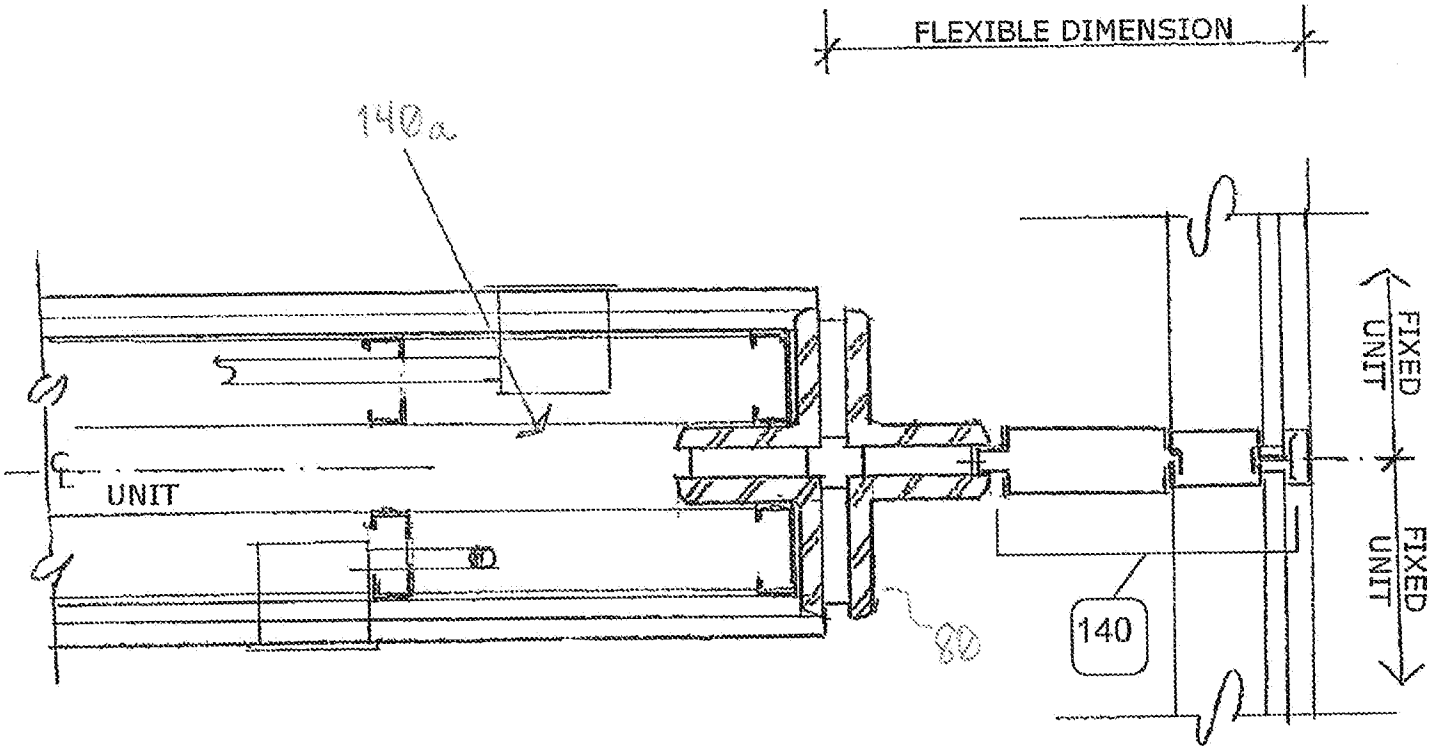
FIG. 14 illustrates a view of a universal split partition interior finish assembly, where the split partition permits the field connection of units and inspection of all required infrastructure in the wall partition, according to an embodiment of the present invention.

Referring now to FIG. 14, a universal split partition 140 is shown. The universal split partition 140 is a fully finished open-back inspection-ready interior partition 140*a* that acts as an interior finish and decorative assembly. The construction of such allows for connection to a universal column 80 as shown in the fixed and flexible dimensions.

Figure 15:
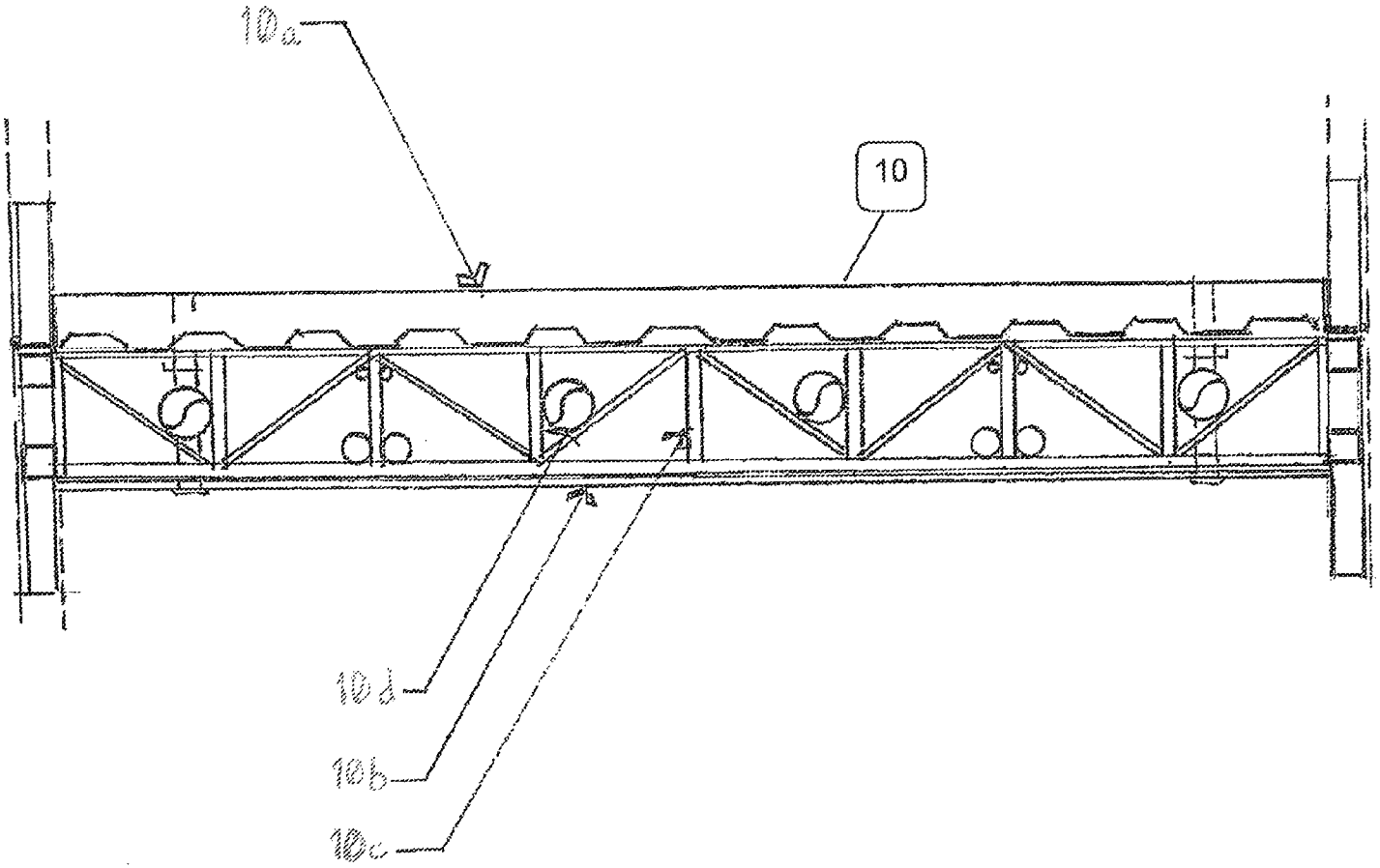
FIG. 15 illustrates a view of a unitized ceiling and wall sandwich assembly, where the assembly is an open system that permits any and all infrastructure to be factory installed and routed through the interior, according to an embodiment of the present invention.

Referring now to FIG. 15, an internal "sandwich" aspect of a floor/ceiling/wall unitized assembly 10 is shown, with a finished floor 10*a* and a finished ceiling 10*b* also shown. The sandwich aspect is a completely trade-integrated unitized assembly 10 containing various systems 10*d*, inserted between the truss structures 10*c*, needed to support the living environment: electrical, plumbing, air-conditioning and heating, and/or insulation components. The sandwich is an open plenum, prefabricated interstitial space that uses the open web of the structure to affix and distribute the MEP infrastructure. Thus each "sandwich" may be support different demands from other sandwiches based on where the particular unitized assembly is to be utilized in construction. For instance, a unitized assembly that is designated for use in a kitchen area will have dense electrical and plumbing components already installed. Alternative, for instance, a unitized assembly designated for use as a ceiling and/or floor will have air-conditioning and heating ducts, lighting, and insulation already installed. Similar sandwich configurations apply directly to multi-family and/or multi-story installation and construction. Further, the open construction of the unitized assembly itself as such permits local re-inspection and further trade installation if necessary. Accordingly, the finished "sandwiches" (with the flip column detail) apply all the benefits of controlled manufacturing without sacrificing interior ceiling height or limiting exterior expression, and overcome the constraints of transportation/geographic limitations, project delivery speed, and allow for consistent execution quality.

Referring now to FIG. 16, a profile view of a MEP (mechanical, electrical and plumbing) flex joint connector 160 is shown. The flex-joint connector 160 is a proprietary mechanical, electrical and plumbing joinery that allows for connection of the various pre-installed trades upon connection and assembly of the various "sandwiches" of unitized assemblies 10. For instance, the design of the connector 160 permits the flexibility of joining of plumbing mechanicals or HVAC system mechanicals during connection of unitized assemblies. Further, the connector 160 permits inspection and testing of systems prior to such unitized assemblies connection, and also allows for the movement introduced in an earthquake and hurricane condition.

Referring now to FIG. 17, a "green-bundled" system 170 and a "wet module" system 171 are shown in conjunction. The "green-bundled" system 170 is a proprietary composite of green technology that controls the systems for lighting, HVAC and plumbing (i.e., light, water and air) purification and performance. The system 170 can be incorporated into the "sandwich" of a unitized assembly 10 or set apart as its own module system and connected where needed through appropriate joineries to next to or below a unitized assembly 10. The "wet module" system 171 is a proprietary composite of plumbing fixtures contained and fixed in a pre-fabricated module of assembled unitized assemblies 10. Such plumbing fixtures in the system can include, for example, a fully installed tub and shower 171*a*, sink 171*b* or toilet 171*c*. The system 171, like the ceiling sandwich, is a fully finished, shippable wet module. Unlike the wall or ceiling sandwich, it is a box unit defined by a unitized ceiling sandwich below and a rigid frame at the door head height above. This rigid frame is designed to support the water and air units in the ceiling and continuous louvers on the perimeter. Such construction and pre-assembly allows for an ability to "plug" the system 171 into various locations based the floor plan configuration.

Referring now to FIGS. 18 and 19, the utilization of fixed/flexible assembly units describes the system flexibility in form and dimension. Such fixed/flexible assembly units come in two types, that is, a fixed and flexible exterior assembly unit 180 and a fixed/flexible interior assembly unit 190. At a large scale, the form, proportion, and shape of the spaces, exterior and roof can be equally personalized to address the specific needs of the customer or conditions of the site by the flexibility provided by the assembly joineries. At a detailed level, the discussion of the collection column designs (as shown in FIGS. 20-28) demonstrate the specific relationship of emotions to features of the physical environment. The assembly units have grains that are fixed to marry to another module and grains that are flexible to address the visual or programmatic needs of a design. The pattern of fixed and flexible dimensions yields great dimensional flexibility in a shippable format.

Referring now specifically to FIG. 18, an example of fixed/flexible exterior assembly units utilized in such construction is shown. For example, the exterior assembly unit 180 forms the exterior profile of the living environment, such as outer walls or rooftops. Also, for example the interior assembly unit 190 is utilized in the interior aspects of the living environment, such as inside walls. Referring now specifically to FIG. 19, each type has both fixed and flexible Portions, as shown, and in this case they are stacked in section. The configuration demonstrates the ability to easily create double story interior heights and roof forms. The fixed portion relates to that aspect of the assembly unit which is fixed in dimension, while the flexible portion relates to that aspect of the assembly unit which is flexible in dimension. Such combination of fixed and flexible portions allows for greater use of geometry and "sizing" of the living environments. The flexible portions of the assembly units is created through the use of supporting elements within the unit.

Figure 20:
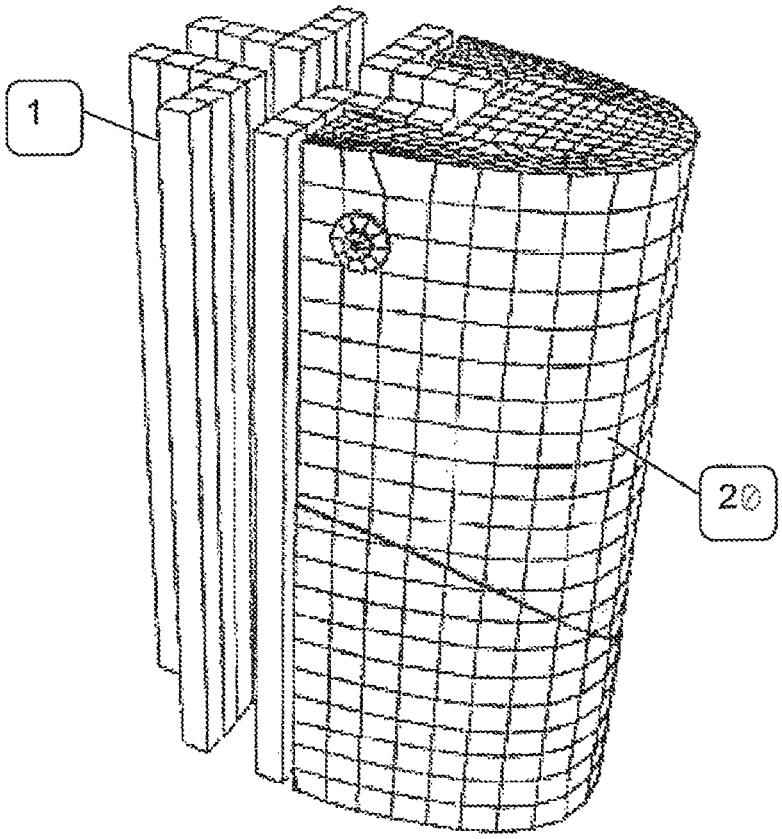
FIGS. 20 through 28 illustrate various ooiversal column Signature Collections, a representative set of passion inspired forms that demonstrate the influence of the behavioral analysis not only on the overall form of the structure but also integral to the details of the system, according to an embodiment of the present invention.
Figure 21:
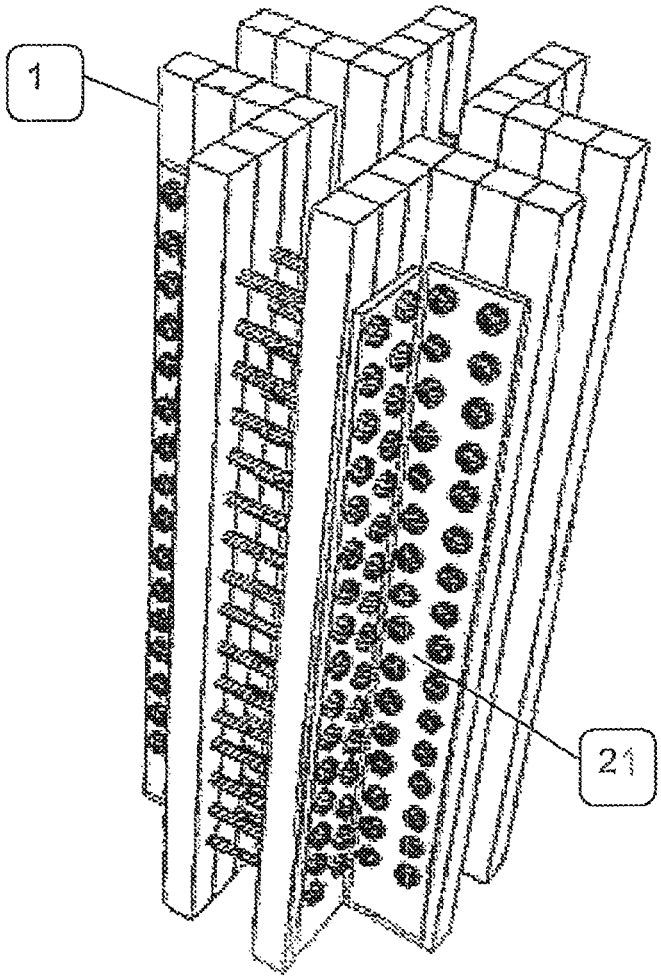
Figure 22:
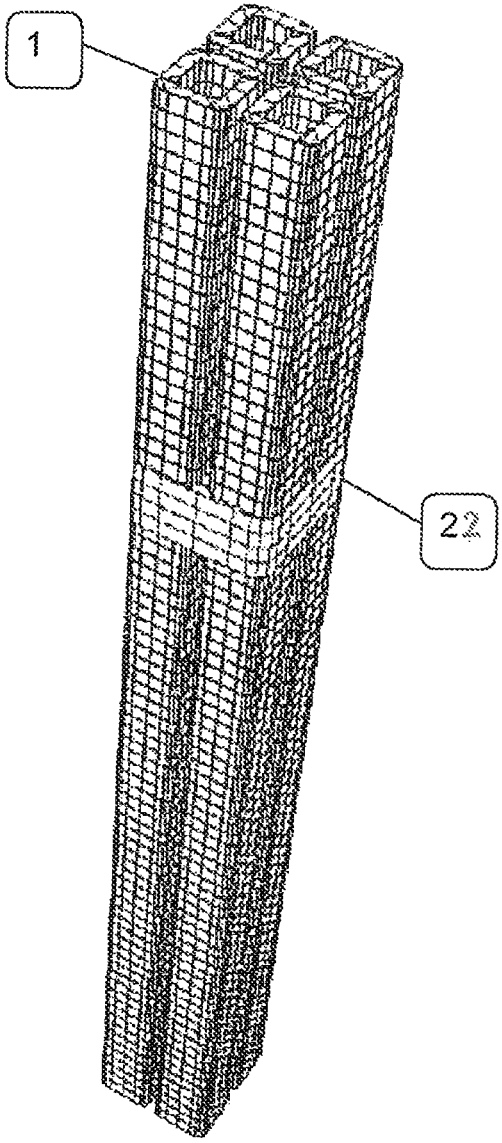
Figure 23:
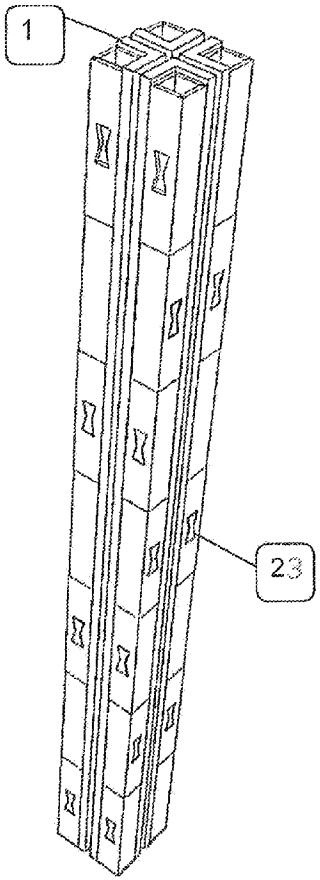
Figure 24:
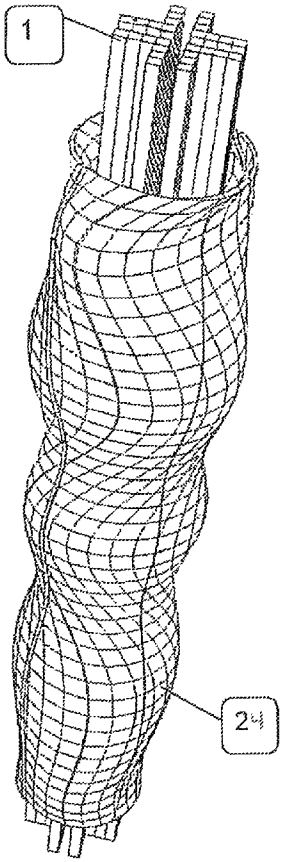
Figure 25:
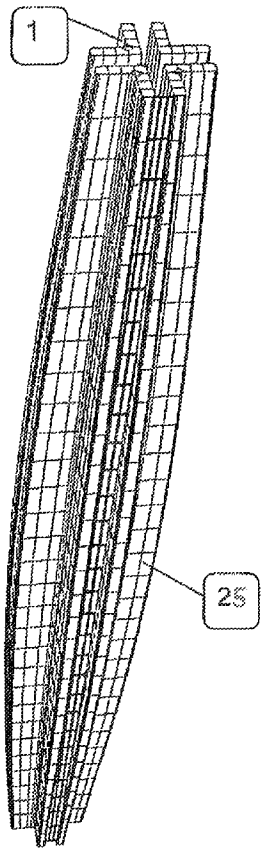
Figure 26:
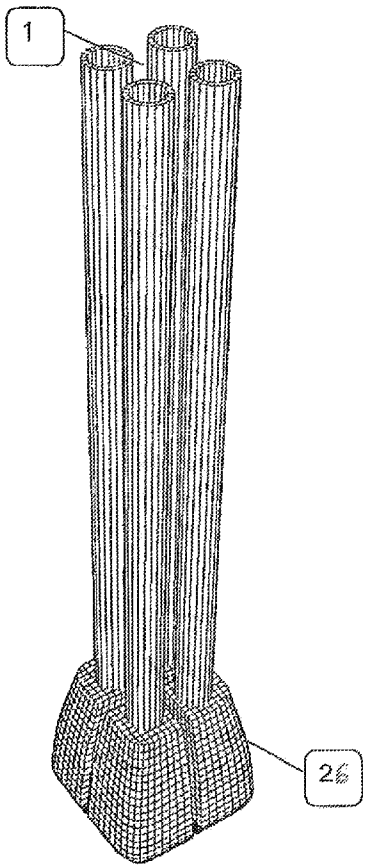
Figure 27:
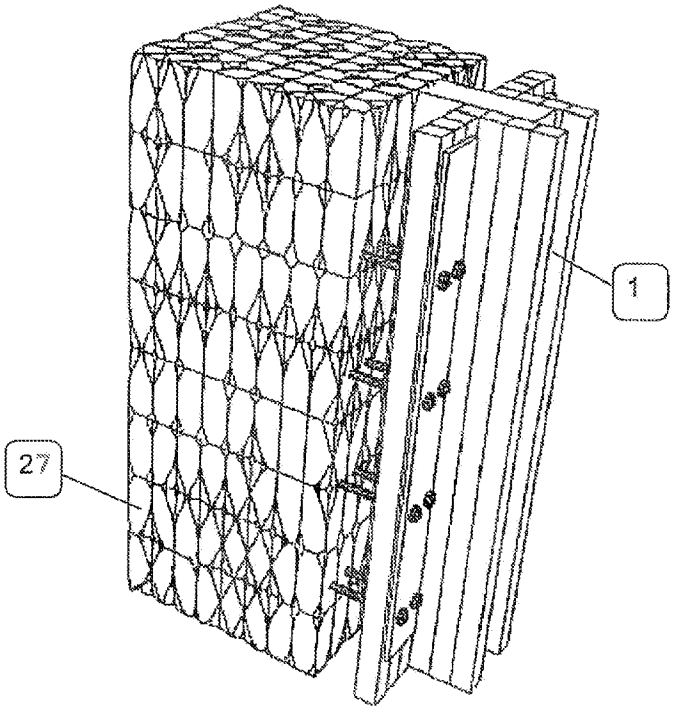
Figure 28:
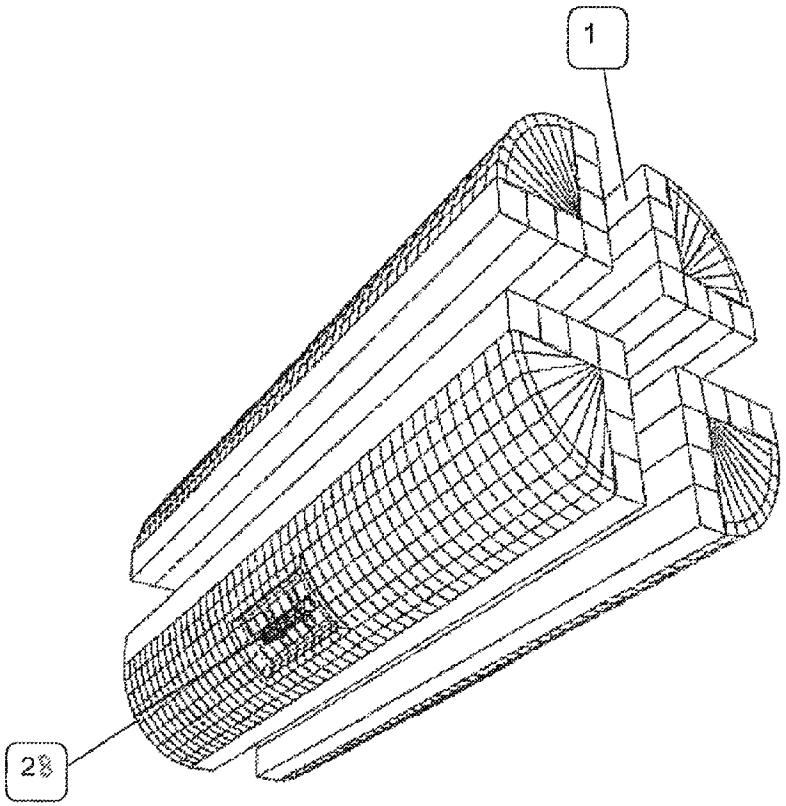

Referring now to FIGS. 20-28, various universal column Signature Collections 40 are shown. The collections each have a "signature" that relates to the active passion(s) of the customer/homeowner as described above. The "signature" connects to the universal column 80 by various means, which column is acting as a support column between the various unitized assemblies 10. For instance, FIG. 20 shows the "America's Cup" signature 20 as attached to a universal column 1, FIG. 21 shows the "Cabernet" signature 21 as attached to a universal column 1, FIG. 22 shows the "The Tour" signature 22 as attached to a universal column 1, FIG. 23 shows the "Tea" signature 23 as attached to a universal column 1, FIG. 24 shows the "Triannale" signature 24 as attached to a universal column 1, FIG. 25 shows the "Autobahn" signature 25 as attached to a universal column 1, FIG. 26 shows the "The Hunt" signature 26 as attached to a universal column 1, FIG. 27 shows the "Gentleman Farmer" signature 27 as attached to a universal column 1, and FIG. 28 shows the "Vinyasa" signature 28 as attached to a universal column 1. It is to be understood that many other variations of Signature Collections may be created based upon a customer/homeowner's passions, and thus such signature list is not to be considered exhaustive or complete by any means. The grouping does demonstrate the range of expressions and in category show how any number of future combinations can be created within the integrity of the system.

Accordingly, as can be seen from the above detailed description with accompaniment of the various figures, the construction and architectural system of the present invention enable a hybrid manufacturing. That is, components may be manufactured in idela manufacturing regions, shipped anywhere in the world, and effectively assembled at the site that has been selected for the home. Additionally, the construction and architectural system in combination with the human factors based analysis and the various themed Signature Collections, allows for efficient access and development of a personalized living environment.

Additionally, the open system of construction as it is set forth by the present invention, allows for branded and bundled technology to be integrated with the unitized assembly and assembly joineries. This open system allows for universal construction and energy code compliance. The one infrastructure design is designed to be capable of meeting all applicable code standards for all contingencies—hurricane, earthquake, energy, etc. The constructed components also allow meet all international certifications: UL, MEA, etc., and in so doing allow for a national execution network of licensed exclusive professionals.

In the foregoing description, the method and apparatus of the present invention have been described with reference to specific examples. It is to be understood and expected that variations in the principles of the method and apparatus herein disclosed may be made by one skilled in the art and it is intended that such modifications, changes, and substitutions are to be included within the scope of the present invention as set forth in the appended claims. The specification and the drawings are accordingly to be regarded in an illustrative rather than in a restrictive sense.

What is claimed is:

1. An apparatus for construction of a personalized living environment, the apparatus comprising:

at least one unitized assembly having a fixed/flexible trade-integrated "sandwich";

at least one drop column insert rotatably secured to the at least one unitized assembly;

at least one rigid stacking stud fixedly secured to the at least one unitized assembly; and at least one universal column, which connects to the at least one unitized assembly via at least one of the at least one drop column insert and at least one rigid stacking stud.

2. The apparatus according to claim 1, wherein the fixed/flexible trade-integrated "sandwich" has incorporated into it internal home mechanicals, comprising at least one of: structural components, electrical components, plumbing components, and HVAC components.

3. The apparatus according to claim 1, wherein an exterior face of the fixed/flexible trade-integrated "sandwich" is finished, insulated and code compliant.

4. The apparatus according to claim 1, wherein an interior face of the fixed/flexible trade-integrated "sandwich" is completed with a finished trade, comprising at least one of: carpentry, tile, carpeting, wood and stone.

5. The apparatus according to claim 1, wherein the at least one unitized assembly is constructed as a concrete substrate on a steel frame.

6. The apparatus according to claim 1, wherein the at least one unitized assembly is fitted to at least one more unitized assembly by means of an interlocking seal.

7. The apparatus according to claim 1, wherein the at least one unitized assembly is connected to another at least one unitized assembly via at least one of a rotatable drop column inserts and a rigid stacking stud.

8. The apparatus according to claim 1, wherein a dimensioning of the at least one unitized assembly is based upon utilization of a Proportional Algorithm.

9. The apparatus according to claim 8, wherein the Proportional Algorithm is a three dimensional fixed "snap" system in the "x", "y" and "z" dimensions.

10. The apparatus according to claim 1, wherein the at least one universal column comprises two to four adjoining structural "L-shaped" angles.

11. The apparatus according to claim 1, wherein the at least one universal column is constructed of at least one of a hybrid material, comprising: wood/steel, stone/steel, chrome/black steel, and pre-cast concrete/steel.

12. The apparatus according to claim 1, further comprising:

at least one Signature Collection incorporated into at least one of the at least one unitized assembly and the at least one universal column, and wherein a selection of the at least one Signature Collection is accomplished according to a customer's passion.

13. The apparatus according to claim 12, wherein selection of the least one Signature Collection is comprised of the steps of:

applying a human factors behavioral analysis to map a customer's passion;

incorporating an experience blueprint to connect the customer's mapped passion with the selection of at least one Signature Collection.

14. The apparatus according to claim 13, wherein the human factors behavioral analysis utilizes a customer's behavior profile and behavior characteristics to map the customer's passion.

15. The apparatus according to claim 13, wherein the human factors behavioral analysis utilizes behavior segmentation of the customer to map the customer's passion.

16. The apparatus according to claim 12, wherein the at least one Signature Collection comprises at least one of: a "America's Cup" signature, a "Cabernet" signature, a "The Tour" signature, a "Tea" signature, a "Triannale" signature, a "Autobahn" signature, a "The Hunt" signature, a "Gentleman Farmer" signature, and a "Vinyasa" signature.

17. A method of an architectural process for a construction of a personalized living environment, the method comprising the steps of:

utilizing at least one unitized assembly comprising a fixed/flexible trade-integrated "sandwich";

utilizing at least one drop column insert rotatably secured to the at least one unitized assembly;

utilizing at least one rigid stacking stud fixedly secured to the at least one unitized assembly;

utilizing at least one universal column to connect the at least one unitized assembly via at least one of the at least one drop column insert and at least one rigid stacking stud; and selecting at least one Signature Collection.

18. The method according to claim 17, further comprising the step of:

applying a human factors behavioral analysis to map a customer's passion.

19. The method according to claim 18, further comprising the step of:

incorporating an experience blueprint to connect the customer's mapped passion with the utilization of the at least one unitized assembly and to facilitate the customer's selection of the at least one Signature Collection.

20. The method according to claim 17, wherein the at least one Signature Collection comprises at least one of: a "America's Cup" signature, a "Cabernet" signature, a "The Tour" signature, a "Tea" signature, a "Triannale" signature, a "Autobahn" signature, a "The Hunt" signature, a "Gentleman Farmer" signature, and a "Vinyasa" signature.

* * * * *